US007421998B1

(12) United States Patent
Aldrin

(10) Patent No.: US 7,421,998 B1
(45) Date of Patent: Sep. 9, 2008

(54) MODULAR ENGINE

(76) Inventor: Adam F. Aldrin, 42411 Palmer Rd., Canton, MI (US) 48188-1990

( * ) Notice: Subject to any disclaimer, the term of this patent is extended or adjusted under 35 U.S.C. 154(b) by 169 days.

(21) Appl. No.: 11/332,710

(22) Filed: Jan. 14, 2006

Related U.S. Application Data

(60) Provisional application No. 60/644,236, filed on Jan. 14, 2005.

(51) Int. Cl.

| | |
|---|---|
| ***F02B 53/04*** | (2006.01) |
| ***F02B 53/00*** | (2006.01) |
| ***F01C 1/00*** | (2006.01) |
| ***F01C 19/00*** | (2006.01) |
| ***F04C 18/00*** | (2006.01) |
| ***F04C 2/00*** | (2006.01) |

(52) U.S. Cl. ..... 123/236; 123/234; 123/204; 418/264; 418/146

(58) Field of Classification Search ..... 123/236, 123/234, 204; 418/159–264, 146
See application file for complete search history.

(56) References Cited

U.S. PATENT DOCUMENTS

| | | | | | |
|---|---|---|---|---|---|
| 158,664 | A | * | 1/1875 | Adams | 418/264 |
| 582,389 | A | * | 5/1897 | Fleischer | 418/264 |
| 809,637 | A | * | 1/1906 | Spencer | 418/264 |
| 1,228,806 | A | | 6/1917 | Morris | 123/231 |
| 1,320,892 | A | * | 11/1919 | Munn | 418/264 |
| 1,922,363 | A | | 1/1930 | Hapkins | 123/243 |
| 1,970,004 | A | * | 8/1934 | Friedell | 123/236 |
| 2,158,532 | A | | 2/1936 | Bullen | 123/236 |
| 2,248,639 | A | * | 7/1941 | Miksits | 123/204 |
| 2,498,029 | A | * | 2/1950 | Clerc | 418/264 |
| 2,819,677 | A | * | 1/1958 | Leath | 418/264 |
| 3,101,076 | A | | 4/1961 | Stephens-Castaneda | |
| 3,181,509 | A | | 1/1963 | Simon | 123/230 |
| 3,249,096 | A | * | 5/1966 | Franceschini | 418/260 |
| 3,251,348 | A | * | 5/1966 | Unruh | 123/228 |
| 3,486,487 | A | | 3/1968 | Kelly | |
| 3,572,030 | A | | 3/1971 | Cuff | 123/231 |
| 3,696,797 | A | | 10/1972 | Kessler | 123/245 |
| 3,762,375 | A | | 10/1973 | Bentley | 123/243 |
| 3,904,327 | A | * | 9/1975 | Edwards et al. | 418/264 |
| 3,918,414 | A | * | 11/1975 | Hughes | 123/230 |
| 3,989,011 | A | * | 11/1976 | Takahashi | 123/204 |
| 4,075,981 | A | | 2/1978 | Durst | 123/228 |
| 4,088,426 | A | * | 5/1978 | Edwards | 418/264 |
| 4,168,941 | A | | 9/1979 | Rettew | 418/83 |
| 4,209,286 | A | * | 6/1980 | Schwartz | 418/260 |
| 4,548,560 | A | | 10/1985 | Kanao | 418/144 |
| 4,553,513 | A | * | 11/1985 | Miles et al. | 123/204 |
| 4,646,694 | A | | 3/1987 | Fawcett | 123/245 |
| 4,667,468 | A | | 5/1987 | Hansen | 123/248 |

(Continued)

OTHER PUBLICATIONS

G, Dusenberry & D. Carlson, Development of a Hot Gas Vane Motor for Aircraft Starting Systems, Oct. 13-16, 1986; SAE Technical Paper Series # 861714.

*Primary Examiner*—Thai-Ba Trieu

(57) ABSTRACT

An engine is shown and disclosed having individual components that can be optimized depending upon the situation, application or desired performance of the engine. The individual components perform the intake, compression, combustion, expansion and exhaust elements of the cycle. These individual components can all be optimized for the particular application in which this engine is designed. The components can be easily individually controlled either mechanically or electrically and easily removed for repair or replacement.

2 Claims, 35 Drawing Sheets

U.S. PATENT DOCUMENTS

| | | | | | |
|---|---|---|---|---|---|
| 4,760,701 | A | | 8/1988 | David | 123/228 |
| 5,427,068 | A | * | 6/1995 | Palmer | 123/236 |
| 5,429,084 | A | | 7/1995 | Cherry et al. | 123/243 |
| 5,474,043 | A | | 12/1995 | Mallen | 123/241 |
| 5,517,816 | A | | 5/1996 | Faraci et al. | |
| 5,524,586 | A | | 6/1996 | Mallen | 123/243 |
| 5,540,199 | A | * | 7/1996 | Penn | 123/243 |
| 5,596,963 | A | * | 1/1997 | Lai | 123/236 |
| 5,640,938 | A | | 6/1997 | Craze | 123/236 |
| 5,709,188 | A | * | 1/1998 | Al-Qutub | 123/236 |
| 5,836,282 | A | | 11/1998 | Mallen | 123/243 |
| 5,937,820 | A | | 8/1999 | Nagata et al. | 123/243 |
| 5,979,395 | A | | 11/1999 | Mallen et al. | 123/243 |
| 6,125,814 | A | | 10/2000 | Tang | 123/222 |
| 6,128,897 | A | | 10/2000 | Kuhn | |
| 6,244,240 | B1 | | 6/2001 | Mallen | 123/243 |
| 6,651,609 | B2 | | 11/2003 | Nagata et al. | 123/243 |
| 6,688,865 | B1 | | 2/2004 | Matsumoto et al. | 418/145 |
| 2005/0005898 | A1 | | 1/2005 | Horstin | 123/236 |

* cited by examiner

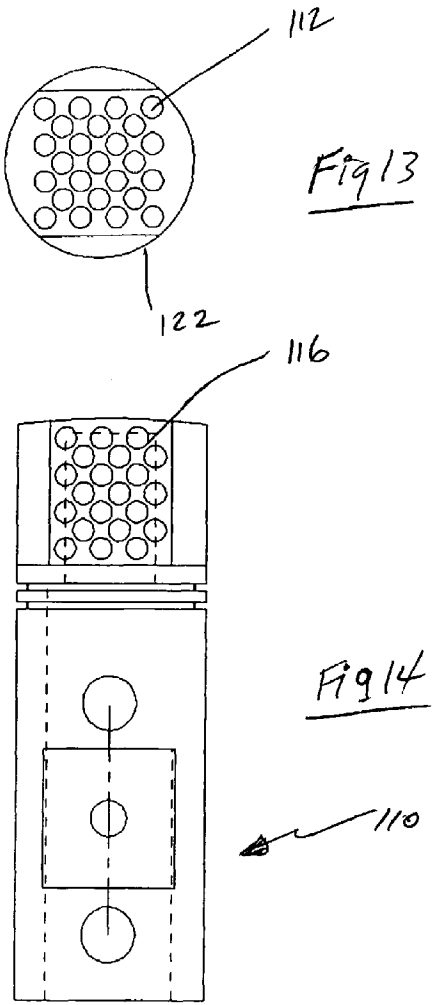
Fig 13
Fig 14
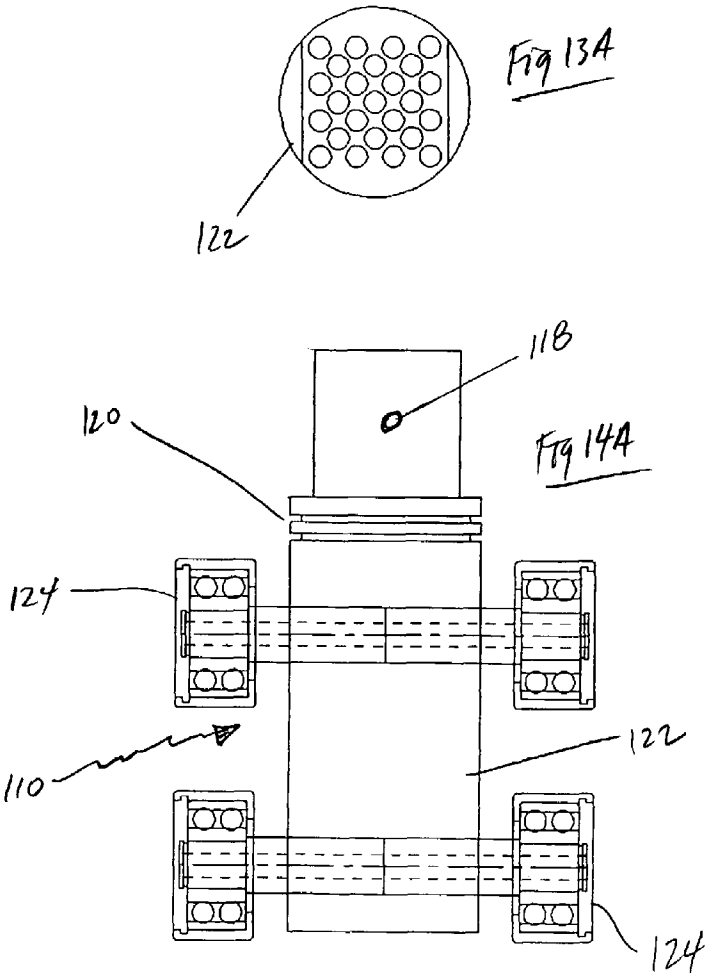
Fig 13A
Fig 14A

MODULAR ENGINE

PRIORITY

This application claims the benefit of U.S. Provisional Application No. 60/644,236 filed Jan. 14, 2005.

FIELD

This invention relates to modular or vaned rotary engines, and more particularly to vaned rotary engines that can be configured to have separate elements or cycles that can be optimized depending upon the application for this modular or vaned rotary engine. Modular or vaned engines can have significant advantages depending upon the application over other types of internal combustion engines.

BACKGROUND

This invention relates to modular or vaned rotary engines, and more particularly to vaned rotary engines that can be configured to have separate modules or cycles that can be optimized depending upon the application for this modular or vaned rotary engine.

Engines generally have several cycles or stages that occur to get power from fuel. Typical engines have two or four cycles. The two cycle engine has an intake cycle and an expansion cycle. The four cycle engine can be described as follows: intake, compression, combustion, and exhaust. All internal combustion engines follow a cycle similar to this, typically the Otto or diesel cycle and have various efficiencies and output. While reciprocating compressors can be good compressors by using mechanical advantage during the compression cycle, it does not yield a good overall engine. Vane style pumps are typically used for high volume, low pressure applications. Vane style pumps however, are not very efficient in the compression cycle but do provide an advantage in the expansion cycle. The embodiments disclosed herein utilizing a vane style pump having five cycles described as intake, compression, combustion, expansion and exhaust or a modified Brayton cycle.

Most engine art accomplishes these cycles by incorporating the necessary elements into the engine itself or a single unit with necessary compromises. This can be beneficial if an engine is being designed for a particular application, but can be inefficient if the engine is being used for a different application. Also, if the design parameters for the device change after the engine design or if the application requires more versatility it can be advantageous to be able to swap in and out various modules. Some of these engine cycles can be optimized by using things such as turbo chargers, timing, fuel and other methods, but primarily, once an engine is designed and built, little variation in the primary cycle parameters can occur.

The devices disclosed in this application have the benefit of having elements that can be modular in design meaning that many of the operating variables can be adjusted, changed or optimized such as timing, compression ratio, speed, thermal and volumetric efficiencies, power output, fuel type, and heat rates. This also means that for example, the compressor can be optimized or adjusted for the type of application that the engine is going to be used for, as can the combustion element, expansion element and exhaust element. Other engine variables such as fuel types, speed, power output, and heat rates can either be adjusted in an existing module or another module can be swapped out that better accomplishes the engine goals. These adjustments can be mechanically or electrically driven and either accomplished manually or automatically based on computer control.

In these embodiments, a vaned rotary engine or expansion chamber can be used where it is most efficient, in the expansion or power generation cycle while other elements can be used where they are most efficient. This modular engine development provides for much greater variation of output parameters as far as the efficiency, horsepower, torque, operating rpm, exhaust byproducts or emissions and others which can be varied depending upon the application for the engine.

For the foregoing reasons, there is a need for a Modular Engine.

SUMMARY

In view of the foregoing disadvantages inherent in the background art regarding optimizing engine cycles and parameters there is a need for a modular vaned rotary engine or independently phased engine or multi staged engine.

A first object of these embodiments is to optimize each of the engine cycles to produce the most efficient output for each cycle depending on the situation and application.

Another object of these embodiments is to produce an engine system that is cost effective to operate.

It is yet another object of these embodiments is to provide an engine system that has a relatively long operating life.

It is a still further object of these embodiments to provide an engine system that is relatively cheap and easy to repair because of the modular components.

Another object of these embodiments is to provide an engine system that can have various modular components replaced rather than replacing the whole engine.

An additional object of these embodiments is to provide an engine system that can be up-sized or downsized relatively inexpensively by changing one or more of the modular elements.

Another object of these embodiments is to provide an engine where the orientation, size and location of the modular components can be adjusted depending upon the intended uses.

Another object of these embodiments is to have these modular elements controlled with respect to one another with either hardware or electronically to optimize performance.

These together with other objects of these embodiments, along with various features of novelty which characterize these embodiments, are pointed out with particularity in the claims annexed hereto and forming a part of this disclosure. For a better understanding of these embodiments, their operating advantages and the specific objects attained by the uses, reference should be had to the accompanying drawings and descriptive matter in which there is illustrated a preferred embodiment of the embodiments.

BRIEF DESCRIPTION OF DRAWINGS

FIG. 13 shows a top view of one embodiment of the vane.

FIG. 13A shows another top view of one embodiment of the vane.

FIG. 14 shows a side view of one embodiment of the vane with the guide shaft assembly removed.

FIG. 14A shows another side view of one embodiment of the vane with guide shaft assembly.

DETAILED DESCRIPTION OF THE PREFERRED EMBODIMENTS

Figure 1:
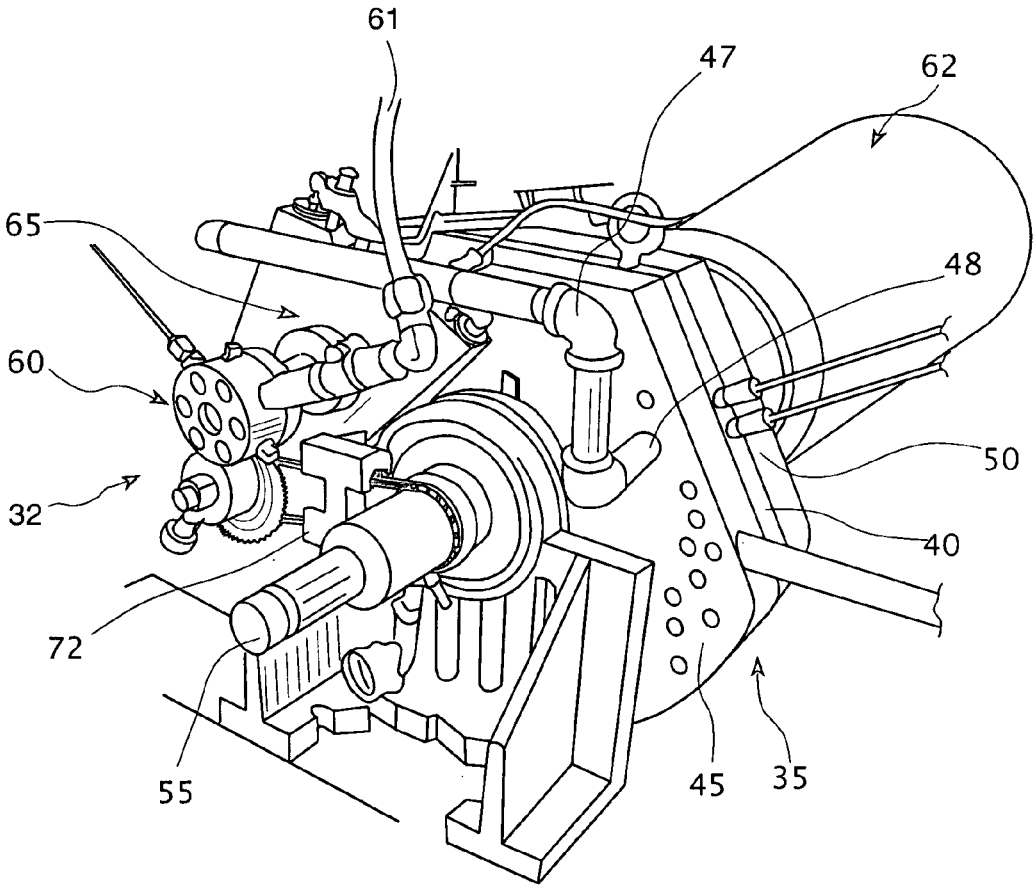
FIG. 1 shows a perspective view of one embodiment of a vane engine.
Figure 2:
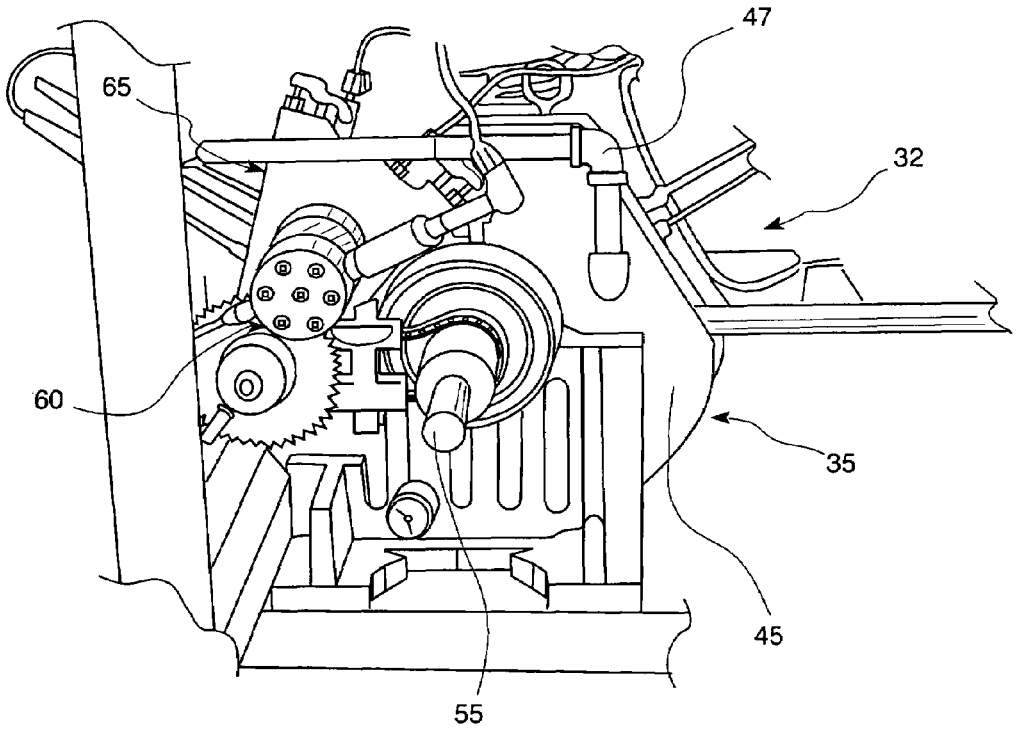
FIG. 2 shows an end view of one embodiment of the vane engine
Figure 3:
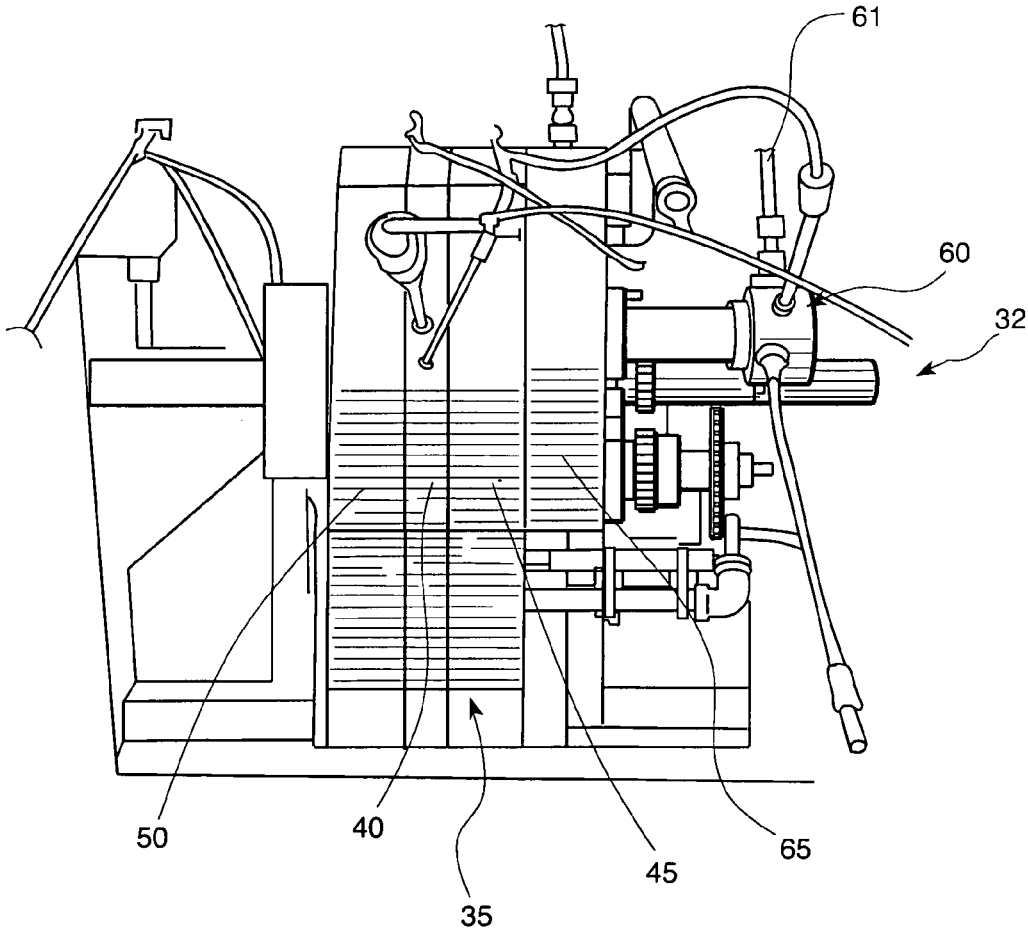
FIG. 3 shows a right side view of one embodiment of the vane engine.

Referring to the drawings in detail wherein like elements are indicated by like numerals, there is shown in FIG. 1 one embodiment of the modular engine 32. The engine 32 is comprised of several elements that can be individually monitored and controlled to optimize the engine 32 components based upon the specific application, situation or desired performance of the engine 32. While these embodiments show one engine 32, it should be understood that multiple engines could be used and run in opposite directions for use in boats and planes. Alternatively, two or more expansion chambers 35 could be used offset from one another by 180 degrees thereby providing a 360 degree power stroke.

Figure 28:
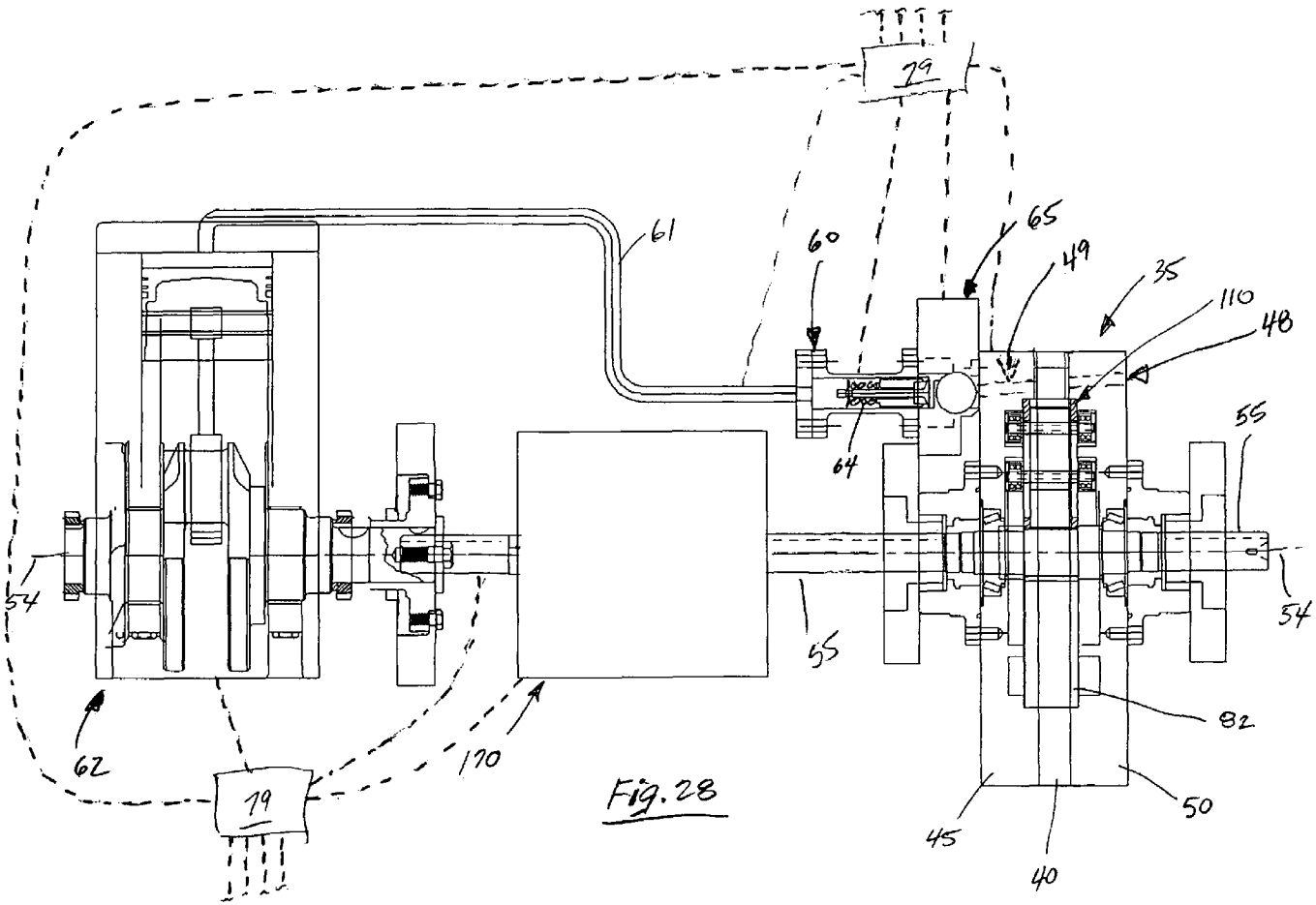
FIG. 28 shows one embodiment of a simplified modular engine having a variable speed drive.
Figure 29:
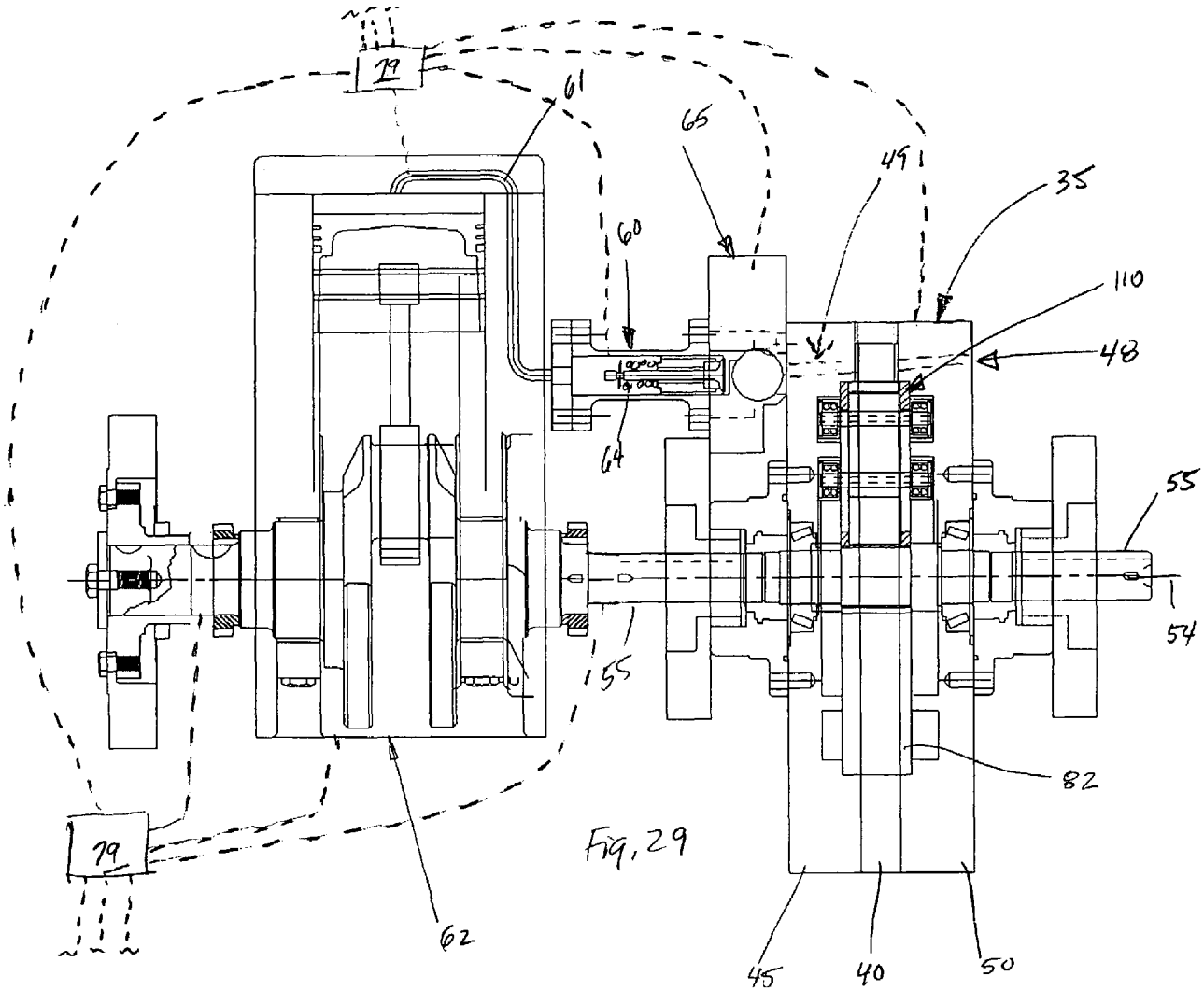
FIG. 29 shows another embodiment of a modular engine without the variable speed drive.

Control of the engine 32 components can be performed by a control module 79 FIGS. 28, 29. This control module 79 can be a computer controlled device or means for reading input parameters and calculating output parameters to optimize engine performance. The control module 79 can also monitor and use other parameters such as fuel, fuel characteristics, air temperature, altitude and many others in determining peak performance or efficiency parameters. The modules can be controlled mechanically or electronically and either automatically or manually.

The engine 32 control module 79 can be adjusted depending on the need for power in for example the three modes: idle, cruise or dash. The control module 79 can be programmed to skip or drop the operation of one or several modules in specific conditions or applications such as cruise. Idle and dash also require different module adjustments to optimize performance.

The engine 32 is comprised generally of the following modules: the compression source 62, the valve body 60, the combustion assembly 65 and the expansion chamber 35.

Alternatively, these components in addition to being individually controlled to optimize performance can be sized or designed for specific applications. They can easily be removed and replaced if maintenance is needed and are relatively cheap to service should they need to be replaced or repaired in the field. Thermal controls can also be used to monitor and optimize each of the modules. Exhaust gas heat may be used to heat modules or a cooler may be used to cool modules. This heating and cooling may be from a common source or each module may have it's own heating and cooling source, not shown.

The compression inlet 61 provides compressed air from the compression source 62. In this embodiment, the compression source 62 is a reciprocating compressor. It should be understood that the compression source 62 could be any device that can provide adequate pressure or volume of compressed air necessary to burn fuel and create power in the engine 32 such as a rotary screw, vane pump, roots blower, diaphragm pump, fan or turbine.

The compression inlet 61 is attached in this embodiment, to the valve body 60. The valve body 60 is also shown in FIGS. 18, 19A, 19B and 19C. The valve body 60 is attached and provides compressed air via passage 59 to the combustion assembly 65 also shown in FIG. 18. The valve body 60 in this embodiment is driven by timing assembly 72, FIG. 1. It should be understood that this timing assembly 72 could be replaced by an electronic timing device to better control the valve body 60.

Figure 4:
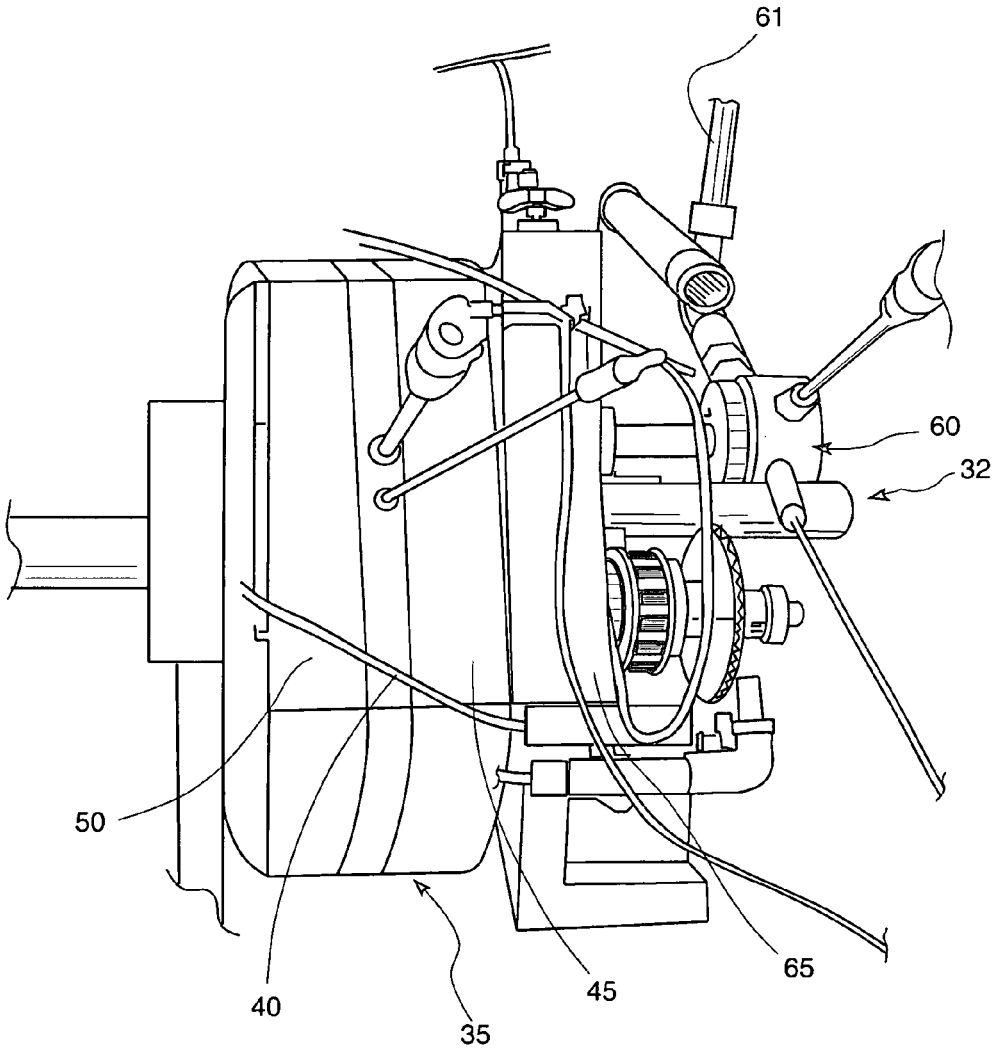
FIG. 4 shows a more detailed view of one embodiment of the vane engine.
Figure 5:
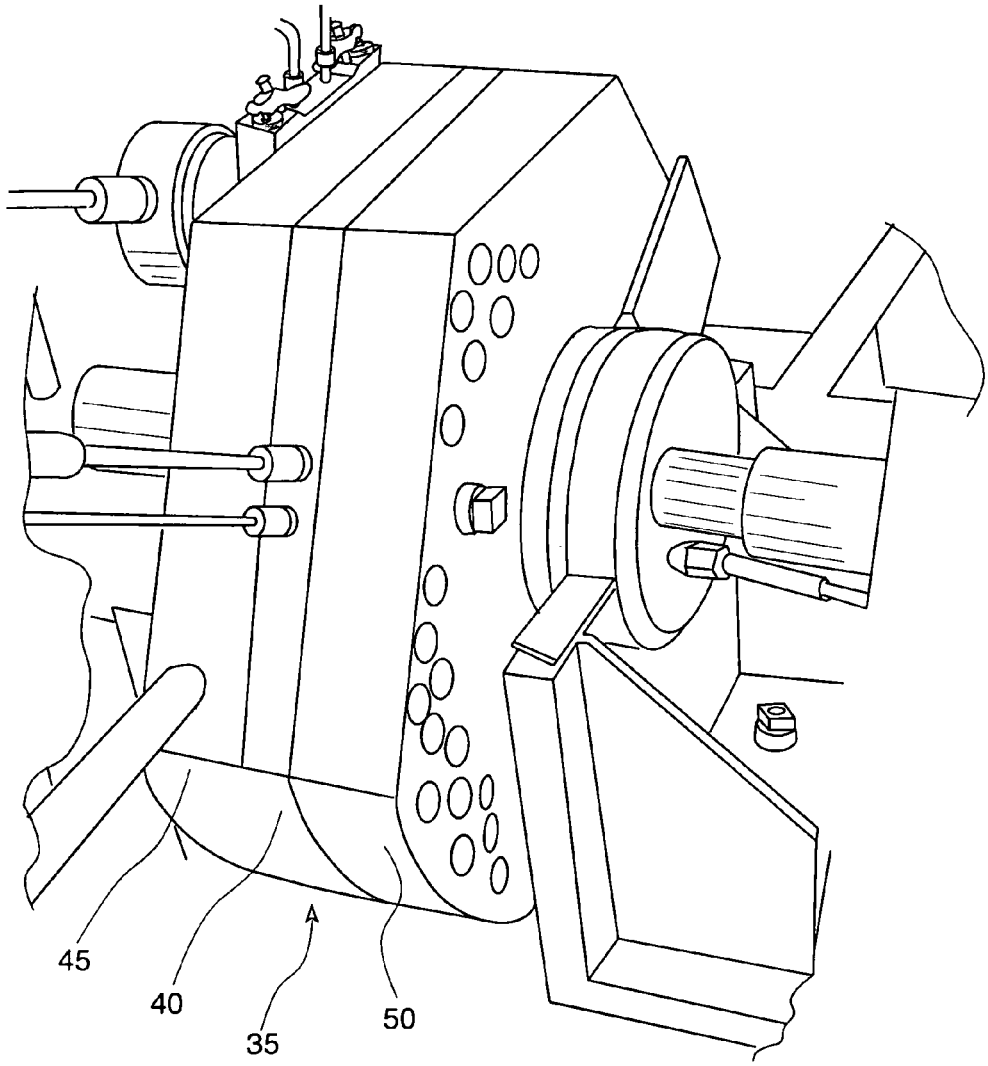
FIG. 5 shows a left side perspective view of one embodiment of the vane engine.
Figure 6:
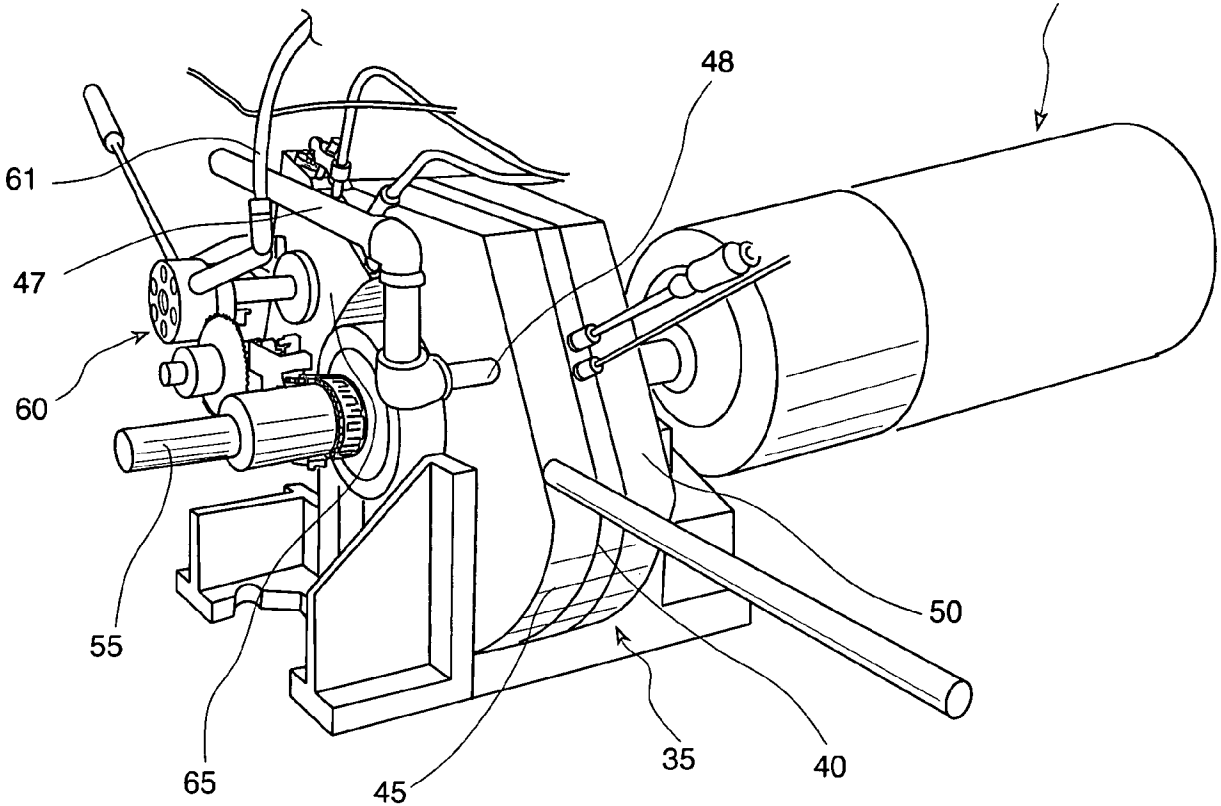
FIG. 6 shows a front perspective view of one embodiment of the vane engine and other components.
Figure 7:
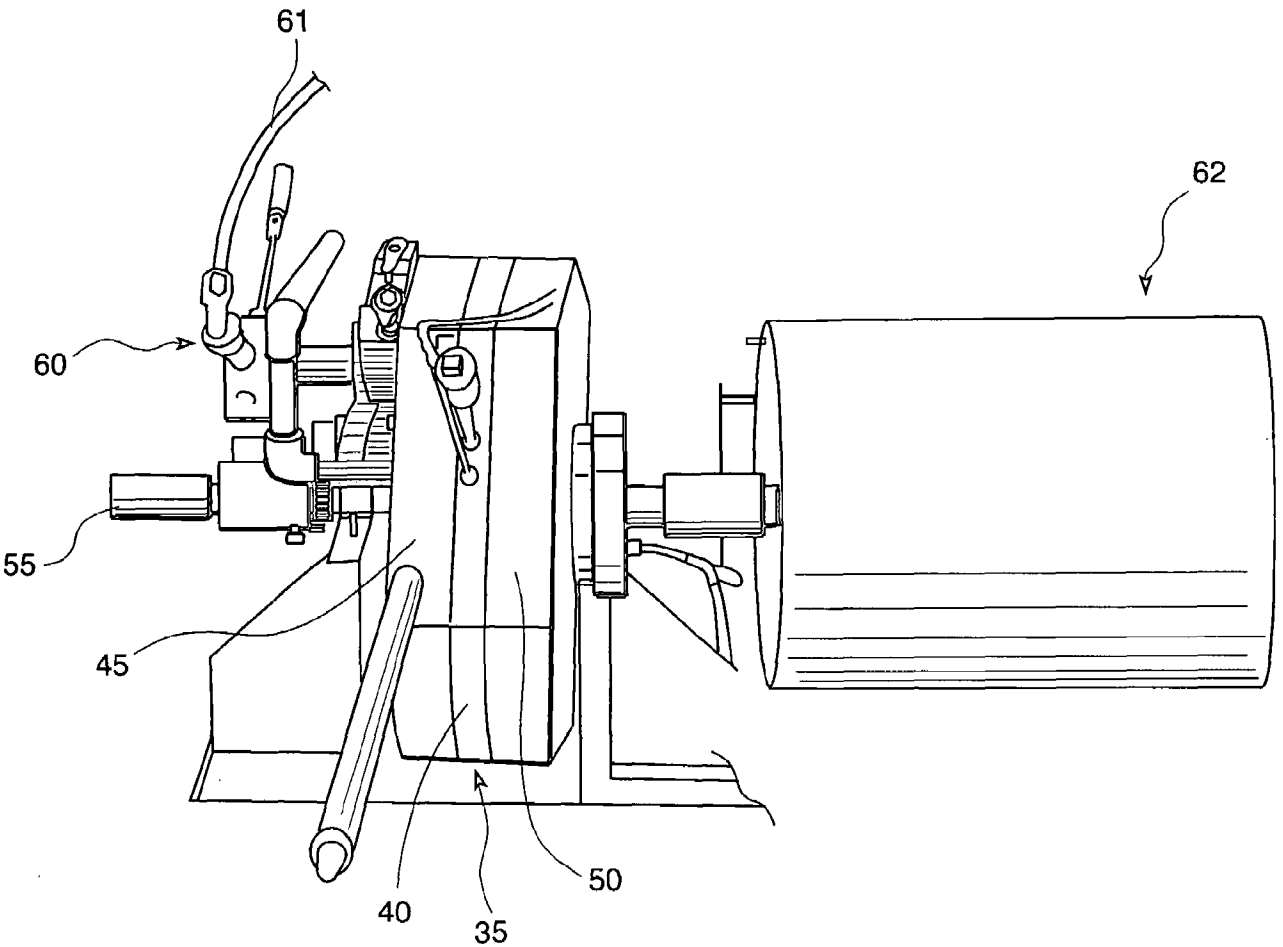
FIG. 7 shows a left side view of one embodiment of the vane engine and other components.
Figure 8:
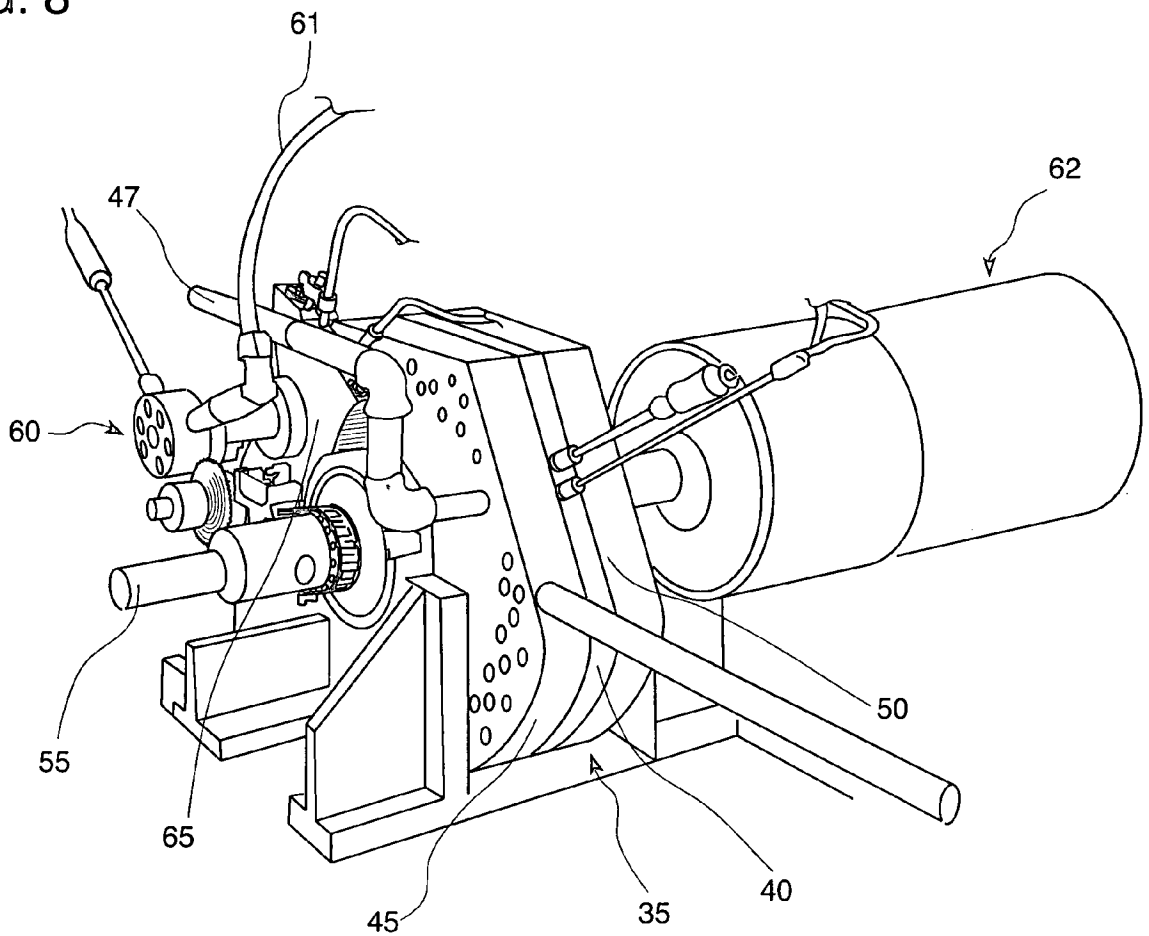
FIG. 8 shows a front perspective view of one embodiment of the vane engine and other components.
Figure 18:
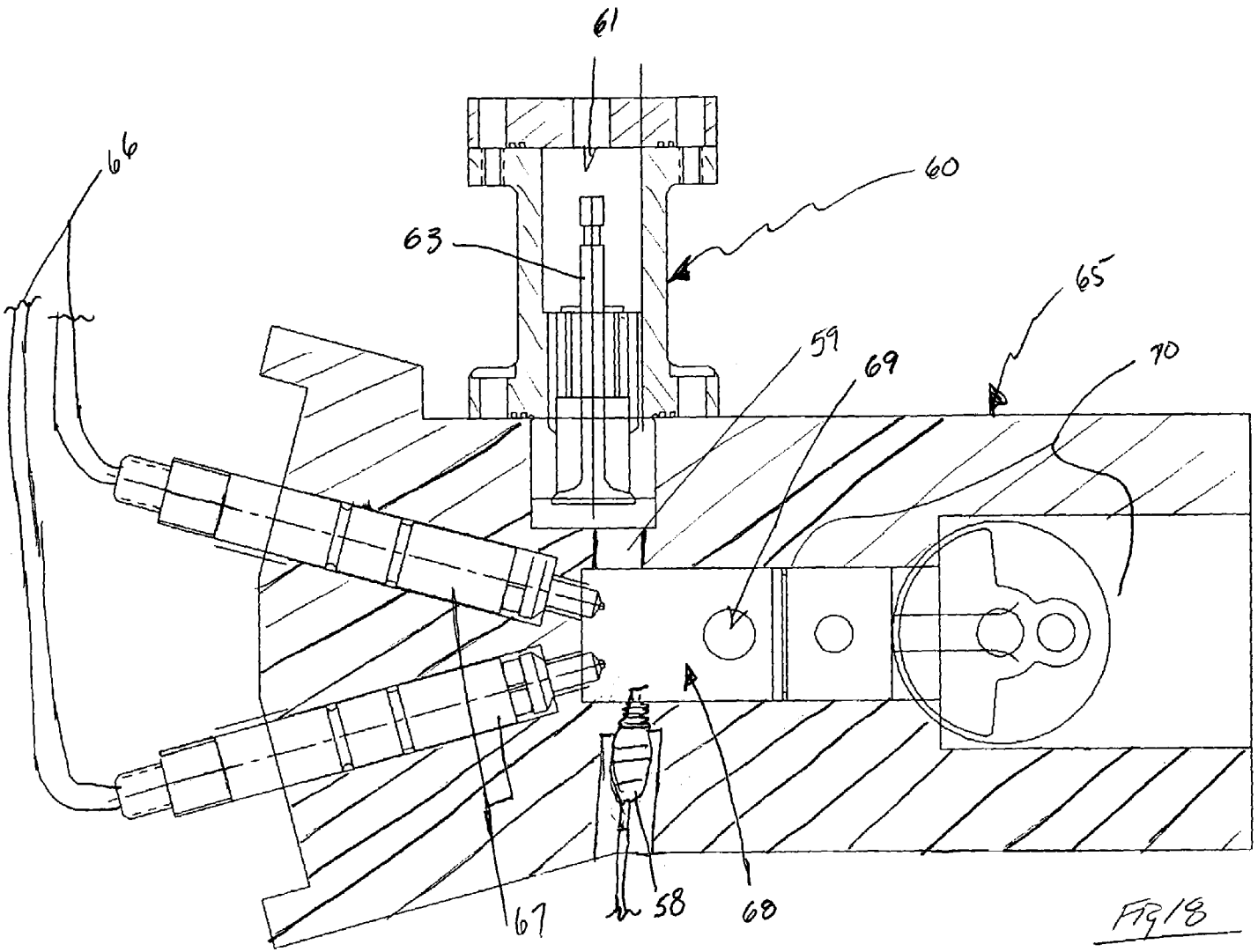
FIG. 18 shows an assembled view of one embodiment of the combustion assembly.

The combustion assembly 65, FIGS. 4, 18, has at least one injector 67 for feeding fuel into the combustion chamber 68 where the fuel is metered and mixed with air from valve body 60 for combustion. The combustion event management of the combustion assembly 65 can be controlled electronically either independently or dependent on feed back from other modules of the engine 32. While this embodiment shows direct fuel injection it is also anticipated that indirect injection or a carburetor could also be utilized. Combustion assembly 65 could also have a plug 58 for igniting the air fuel mixture. While FIG. 18 shows a plug 58 for spark ignition, it should be understood that removal of the plug 58 would allow the combustion assembly 65 to function with compression ignition. The spark versus compression ignition function is dependent upon the design goals for the engine 32.

Figure 9:
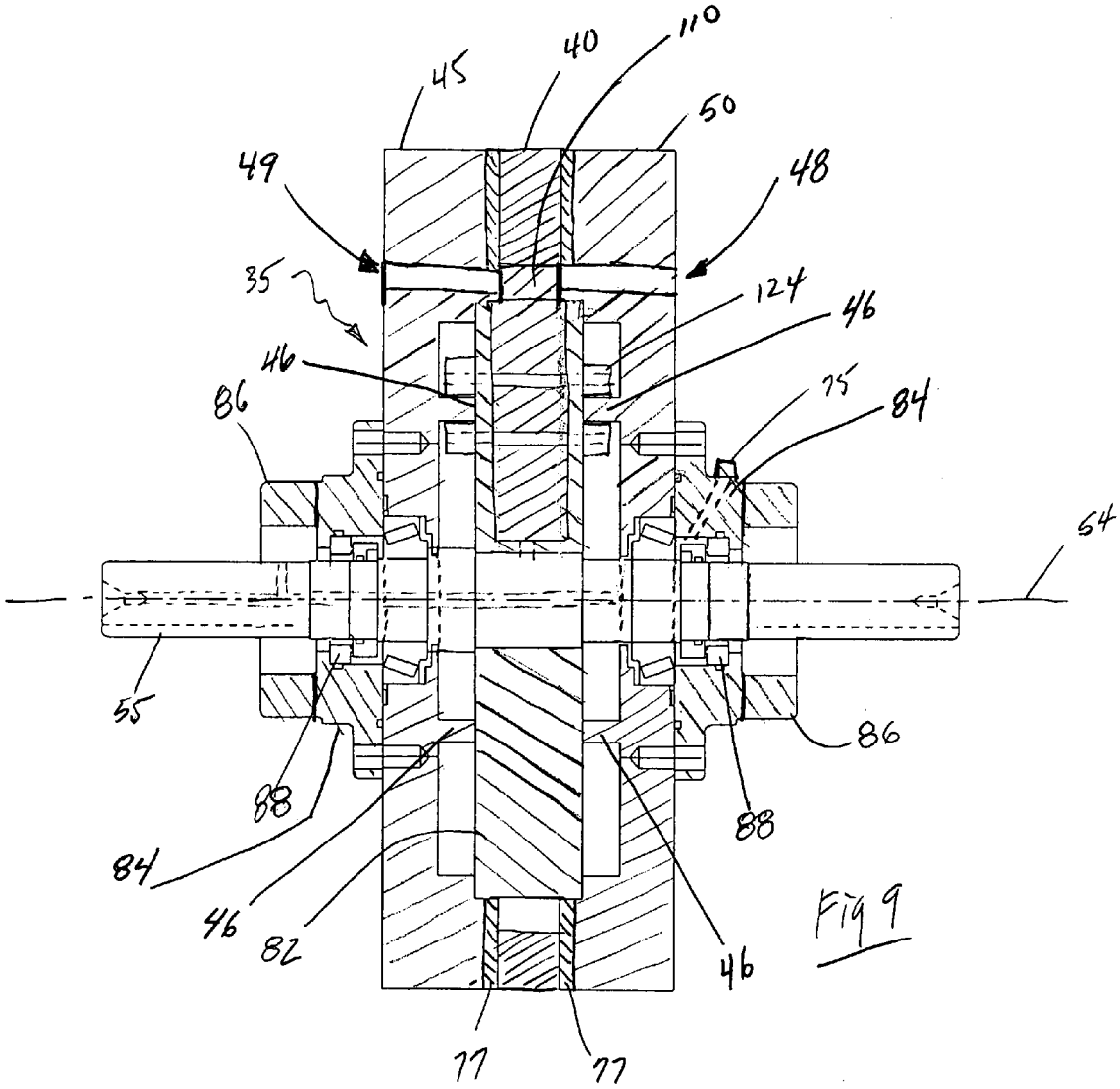
FIG. 9 shows a cross sectioned view of one embodiment of the first plate, second plate, center body, rotor, vane, guide shaft assemblies, shaft, first cap, balancer of the vane engine.
Figure 12:
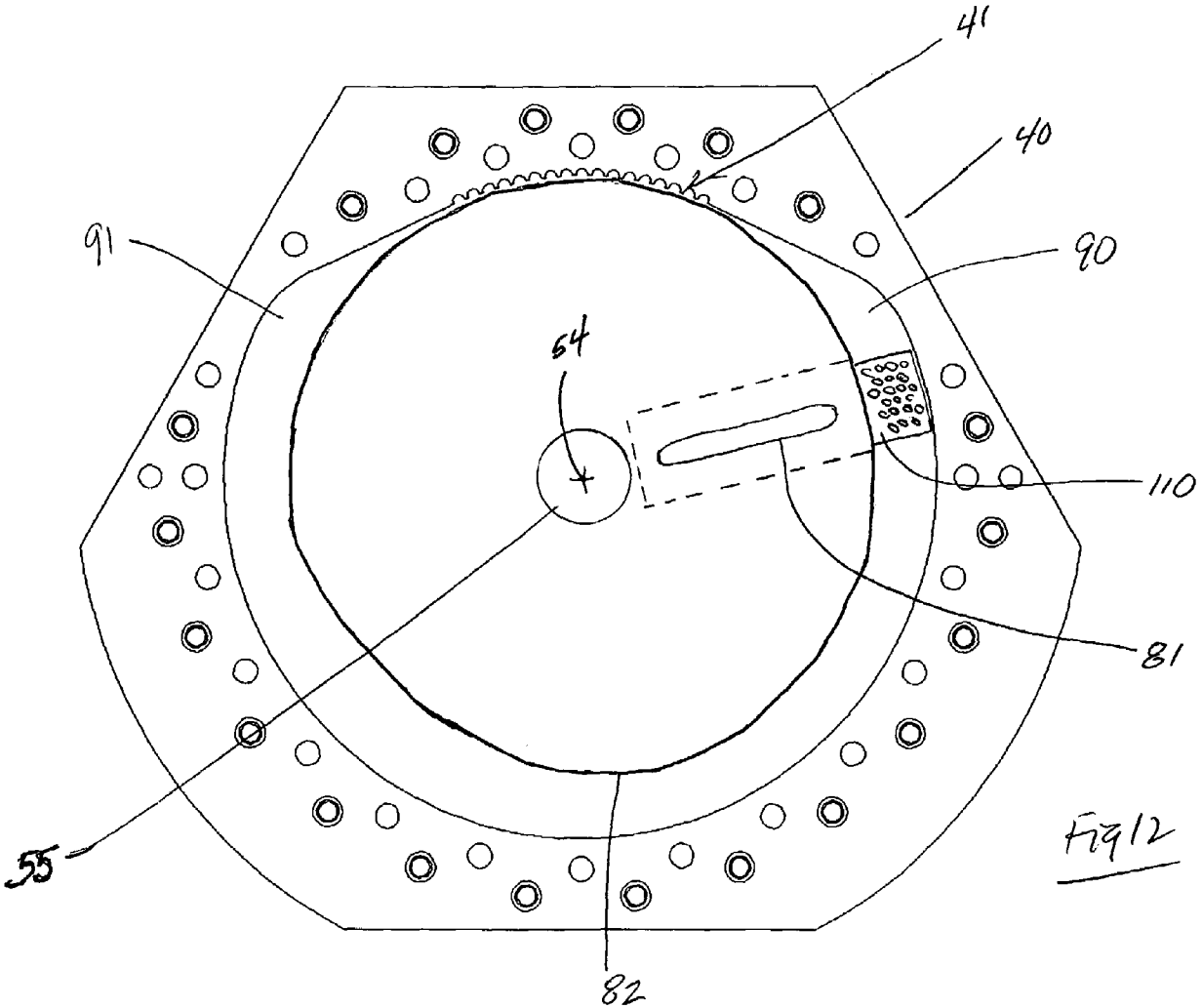
FIG. 12 shows an end view of one embodiment of the center body.

This combusting fuel air mixture is then fed into the expansion commencement 90 area thru expansion port 49 of expansion chamber 35, see FIG. 28. The air fuel mixture continues to burn and expand causing the vane 110 to turn the shaft 55 as best shown in FIG. 12. This expanding fuel air mixture causes the vane 110 and rotor 82 to rotate with the shaft 55 around the shaft axis 54, as shown in FIGS. 9, 12. It should be noted that no contact occurs between the vane 110 and either of the first plate 45, second plate 50 or the center body 40. Seal 41 in the center body 40 and plate seal 62 in the first and second plates 45, 50 and the side seal 116 and top seal 112 of the vane 110 allow these elements to move very closely to one another without contact.

Figure 15C:
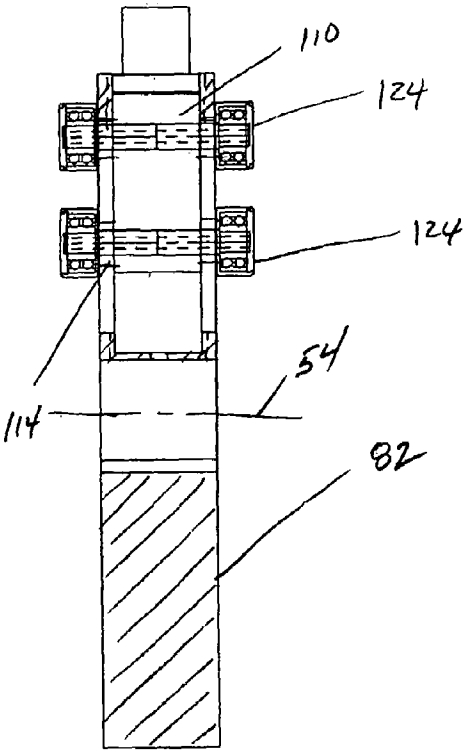
FIG. 15C shows a cross sectional view of one embodiment of the rotor with the vane in another position.
Figure 15B:
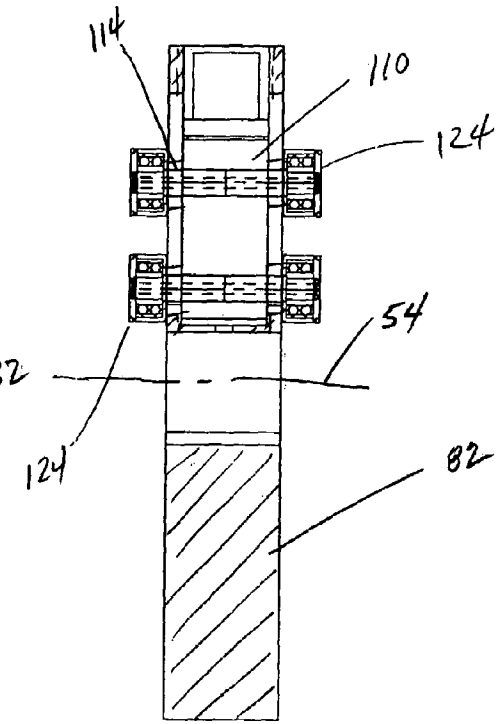
FIG. 15B shows a cross sectional view of one embodiment of the rotor with the vane in one position.

The vane 110 slides within the rotor 82, best shown FIGS. 15B and 15C. The guide shaft assemblies 124 slidably engage the vane 110 with the rotor 82. The guide shaft assemblies 124 ride on each side of the cam 46 of first plate 45, FIG. 17, and the cam, not shown, of second plate 50. The first plate 45 and second plate 50 are mirror images of one another.

The combusted, expanded air fuel mixture is exhausted via exhaust port 48 and exhaust outlet 47 and the cycle begins again.

FIG. 9 shows a cross sectional view of the expansion chamber 35. This figure shows how the first plate 45 is attached to the center body 40 having a gasket 77 in between. The center body 40 is likewise attached to the second plate 50 with a gasket 77 there—between. The rotor 82 houses the vane 110 which moves towards and away from the center of the rotor 82. The vane 110 moves when the guide shaft assemblies 124 ride on the cams 46 of first plate 45 and second plate 50 as the rotor 82 is turned. A pressure relief valve 75 relieves any pressure that leaks into first cap 84 and seal 88 prevents pressure leaks. Likewise, first cap 84 on the other side has a seal 88 and can have a pressure relief valve, not shown.

Figure 10:
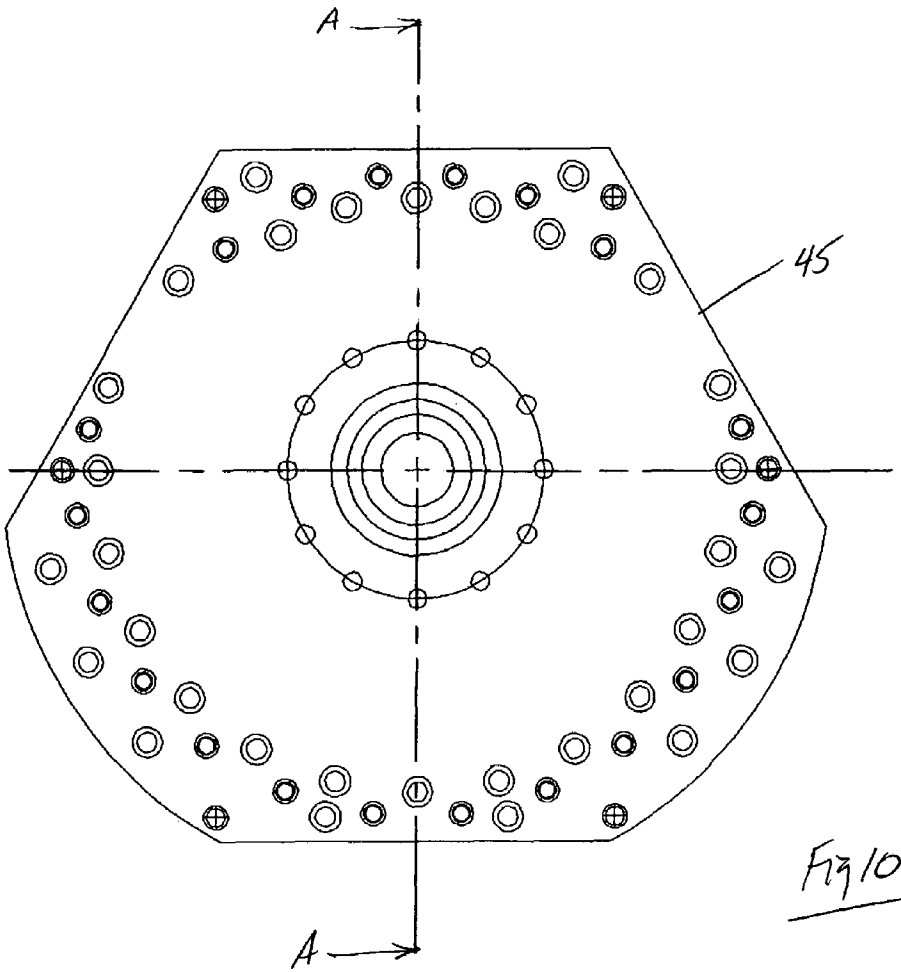
FIG. 10 shows an end view of one embodiment of the first plate.
Figure 11:
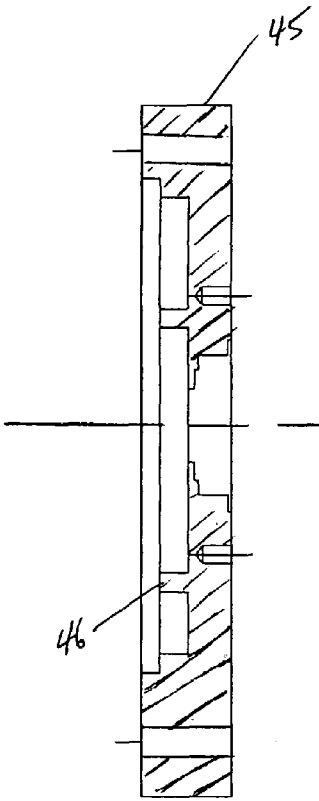
FIG. 11 shows a cross sectional view of one embodiment of the first plate along A-A of FIG. 10.

FIG. 10 shows a side view of the first plate 45 which is identical to second plate 50 as previously noted. FIG. 11 shows a cross sectional view along A-A of FIG. 10 of the first plate 45. The cross sectional view of second plate 50 corresponds to that of first plate 45 in FIG. 11.

FIG. 12 shows a side view of the center body 40 with rotor 82 and vane 110 shown to further explain the function. Center body 40, has a seal 41. The seal 41 discourages leakage between the top seal 112, shown in FIG. 13, of the vane 110 and the center body 40.

Figures 38, 39, 40:
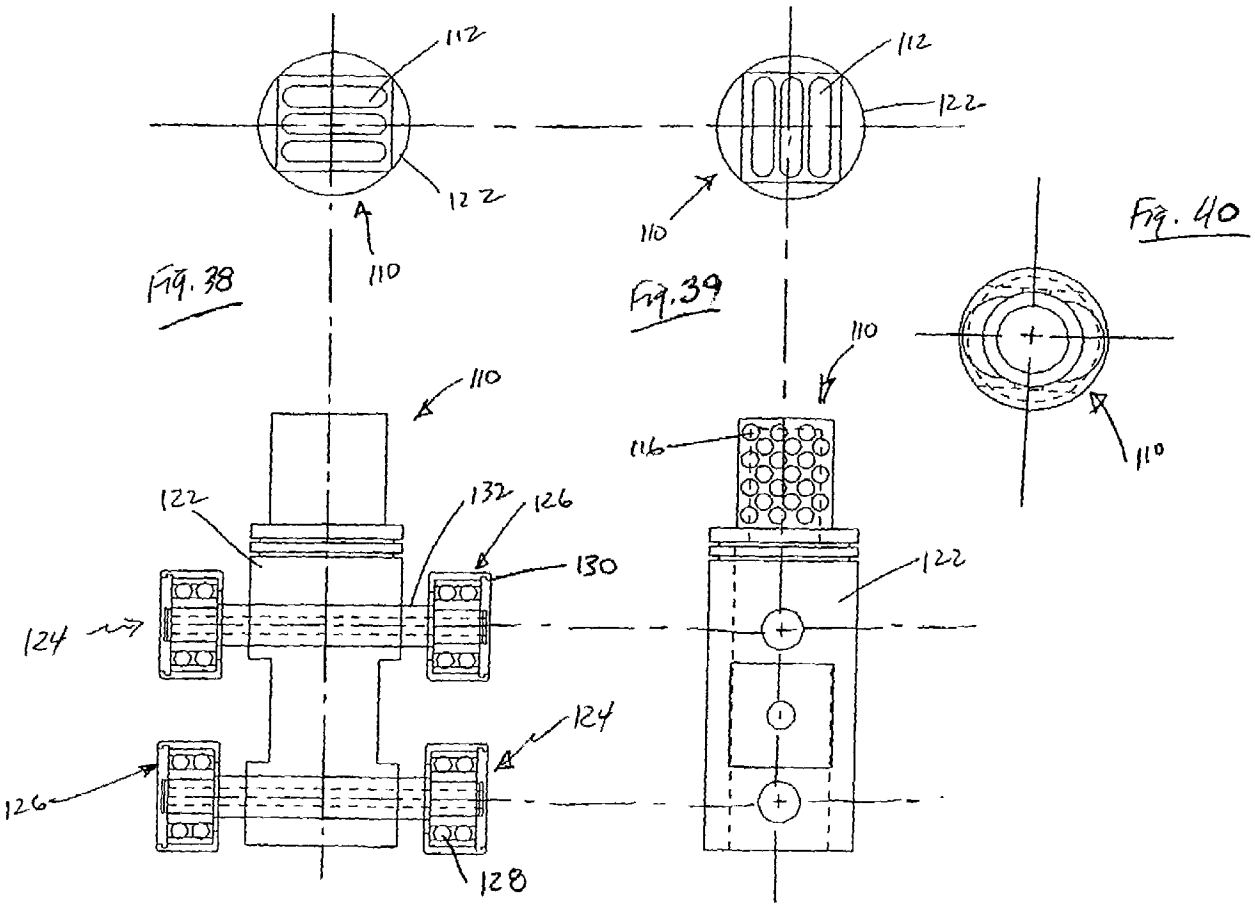
FIG. 38 shows top and side views of one embodiment of the vane.
FIG. 39 shows a top and side view of one embodiment of the vane.
FIG. 40 shows a bottom view of one embodiment of the vane.

FIGS. 13, 13A, 14, 14A show various views of the vane 110 removed from the rotor 82. Various embodiments of the vane 110 are also shown in FIGS. 38-40 and 41-43. FIG. 38 shows that the guide shaft assembly 124 is comprised of a cap 130 into which is placed bearing 128. FIG. 38 shows the cap 130 and bearing 128 are then placed on each end of shaft 132 on opposite sides of vane 110 and secured to shaft 132. The cap 130, bearing 128 and shaft 132 comprise guide shaft assembly 124.

The vane 110 has a side seal 116 and a top seal 112 to seal the expanding fuel air mixture between the first plate 45, second plate 50 and center body 40 to maximize output. This can be seen in FIG. 17 where the plate seal 52 of first plate 45 circumscribes a portion of the first plate 45 and second plate 50. While a standard roller bearing 128 is shown, it should be understood that hydrostatic or hydrodynamic bearings could also be utilized. While no lubricating system is shown, an oil pump and reservoir are required for proper lubrication of moving elements.

Figures 16, 16A:
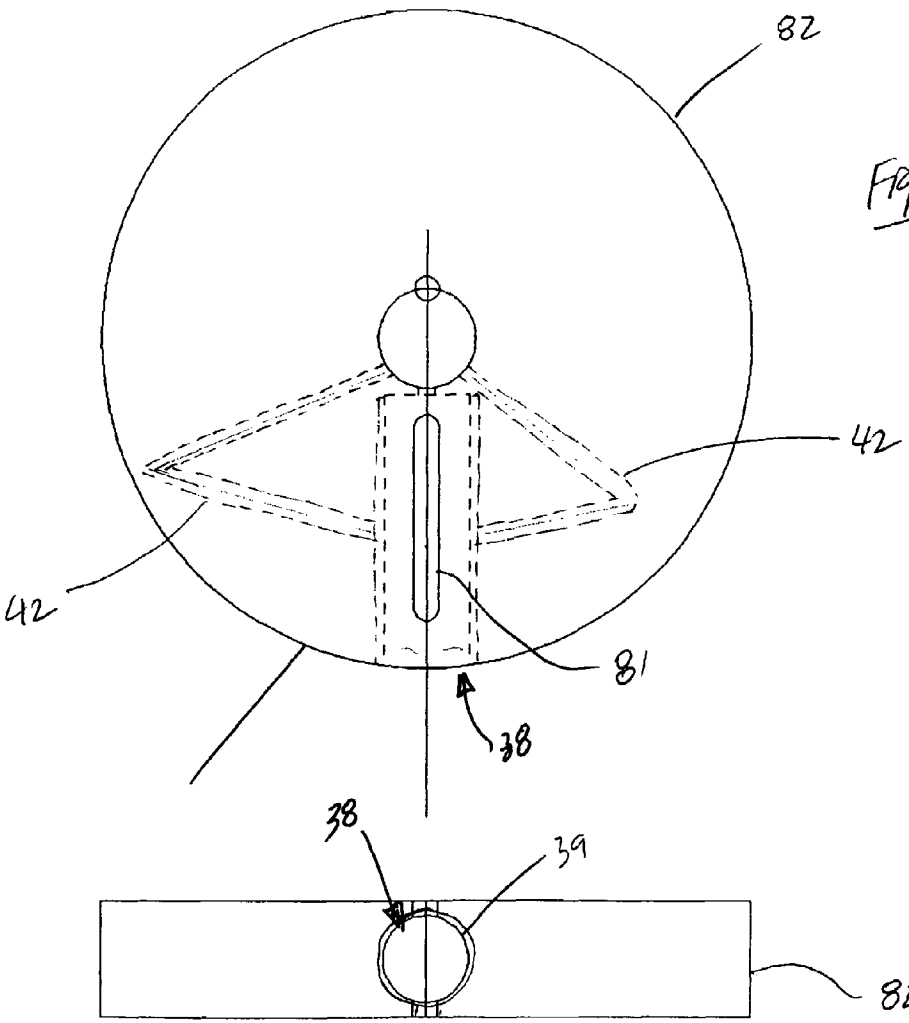
FIG. 16 shows top view of one embodiment of the rotor.
FIG. 16A shows side view of one embodiment of the rotor.
Figure 17:
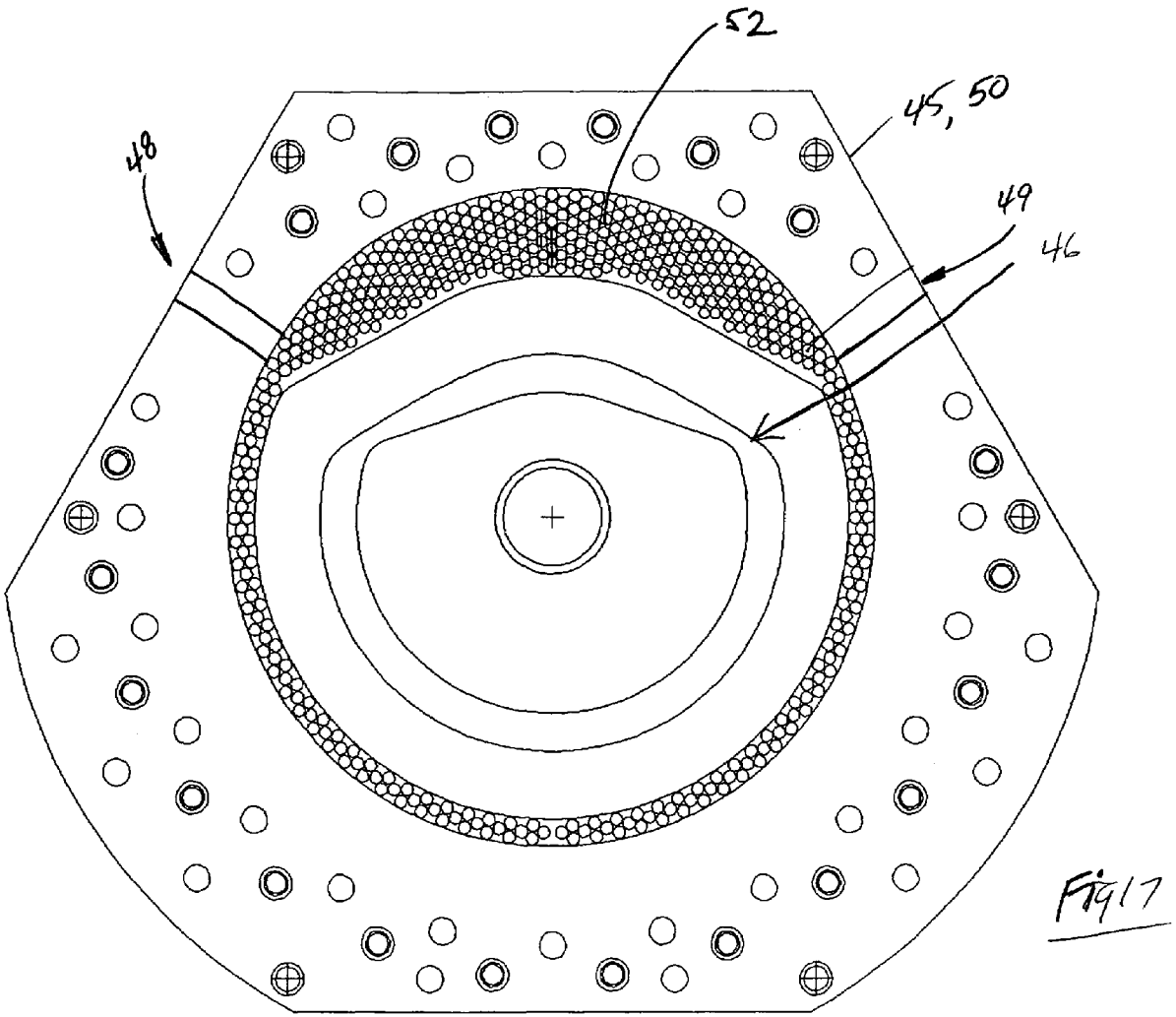
FIG. 17 shows a side view of one embodiment of the first plate.

Also shown are the guide shaft assemblies 124 which ride on the cam 46 of the first plate 45 and the cam 46 of the second plate 50, FIGS. 9 & 17. Also shown in FIG. 14A is oil bleed 118 for bleeding lubricating oil received from the oil passage 56 of the shaft 55, which is shown alone in FIG. 20. Near the oil bleed 118 is body seal 120 to seal the body 122 of the vane 110 and the rotor 82 in hole 38, FIG. 16.

Figure 15A:
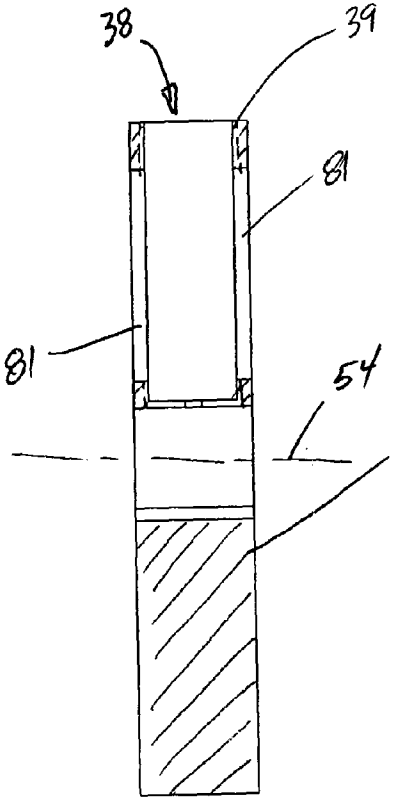
FIG. 15A shows a cross sectional view of one embodiment of the rotor.

FIGS. 15A, 15B and 15C show the vane 110 and the rotor 82 and the movement of the vane 110 relative to the rotor. The guide shaft assemblies 124 slide within the slot 81 of the rotor 82. There is a bushing 114 that aids the smooth movement of the vane 110 in the slots 81 relative to the rotor 82.

FIG. 16 shows an edge view of the rotor 82. FIG. 16A shows a side view of the rotor 82. The rotor 82 has an oil passage 42 for allowing oil to flow to the vane 110 from oil passage 56 of shaft 55, FIG. 20. FIG. 16 also shows a sleeve 39 that can be inserted into hole 38 of the rotor 82 to house the vane 110.

FIG. 17 shows a side view of the first plate 45 with the cam 46 and plate seal 52.

FIG. 18 shows the valve body 60 for allowing compressed air to flow into the combustion assembly 65. The valve body 60 has compression inlet 61 and valve 63 which is opened by the air pressure from the compression source 62 and closes with a spring 64 when the pressure equalizes between the valve body 60 and combustion assembly 65. The valve body 60 can also be controlled electronically based on sensors and algorithms which best support the specific use of the engine 32.

The combustion assembly 65 mixes and lights the air fuel mixture. The burning, expanding air fuel mixture is piped through expansion port 69 to the expansion commencement 90 area as has been previously explained, FIGS. 12, 18. The fuel injectors 67 are attached to the fuel pump (not shown) at the fuel source 66 and draw fuel from the fuel tank, not shown. The fuel injectors 67 can likewise be controlled electronically or through an electro-mechanical system. The fuel injectors 67 can be adjusted to optimum control based on sensors located in other components of engine 32. The valve assembly 70 controls the timing of the fuel air mixture through the expansion port 69. Likewise, valve assembly 70, can be adjusted or controlled electronically or mechanically and optimized based on engine 32 parameters. It should be noted that valve assembly 70 also provides additional compression to the burning expanding air fuel mixture.

Figures 19A, 19B, 19C:
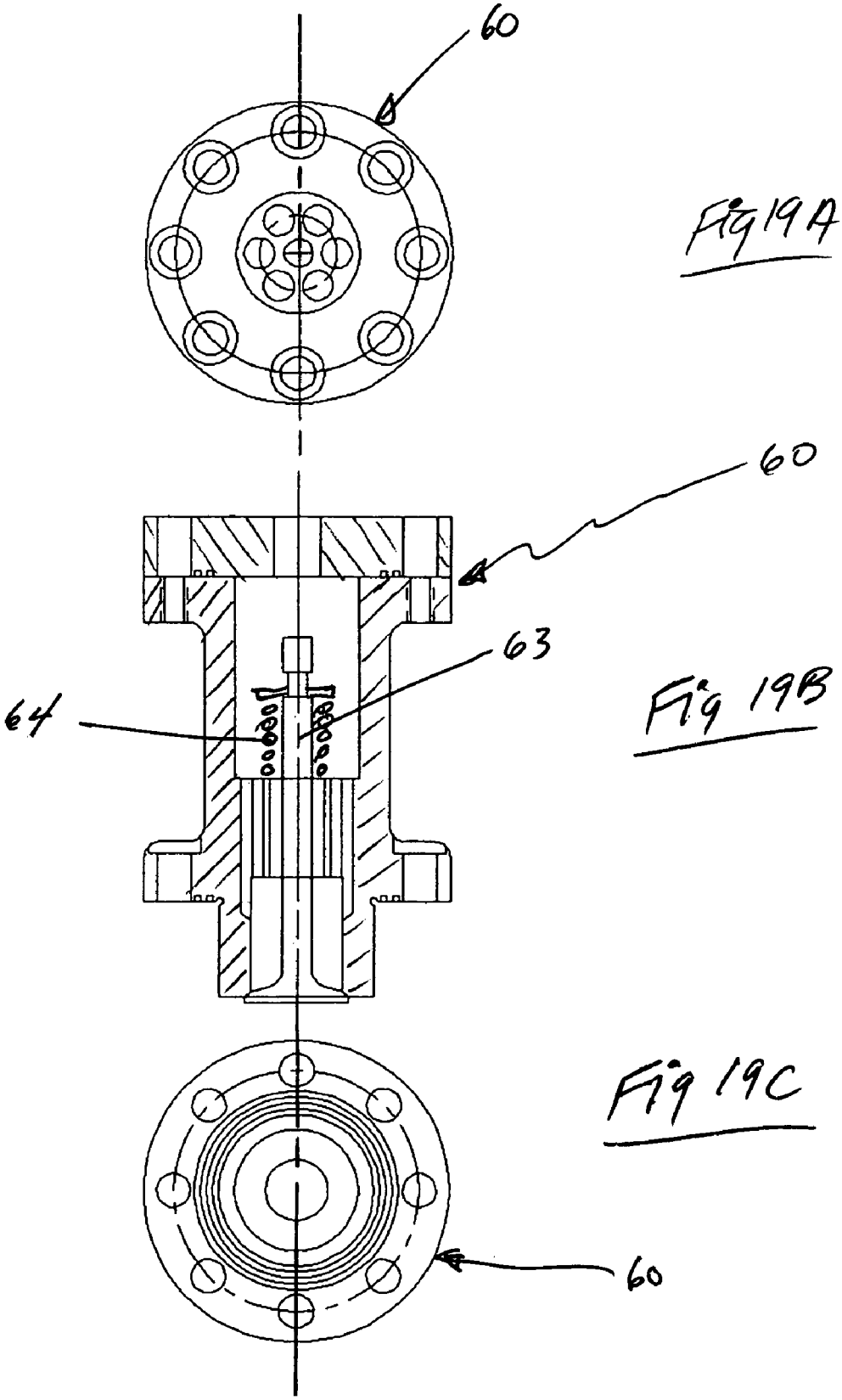
FIG. 19A shows a top view of one embodiment of the compression assembly.
FIG. 19B shows a side cutaway view of one embodiment of the compression assembly.
FIG. 19C shows a bottom view of one embodiment of the compression assembly.

FIGS. 19A, 19 B and 19C show three views of the valve body 60.

Figure 20:
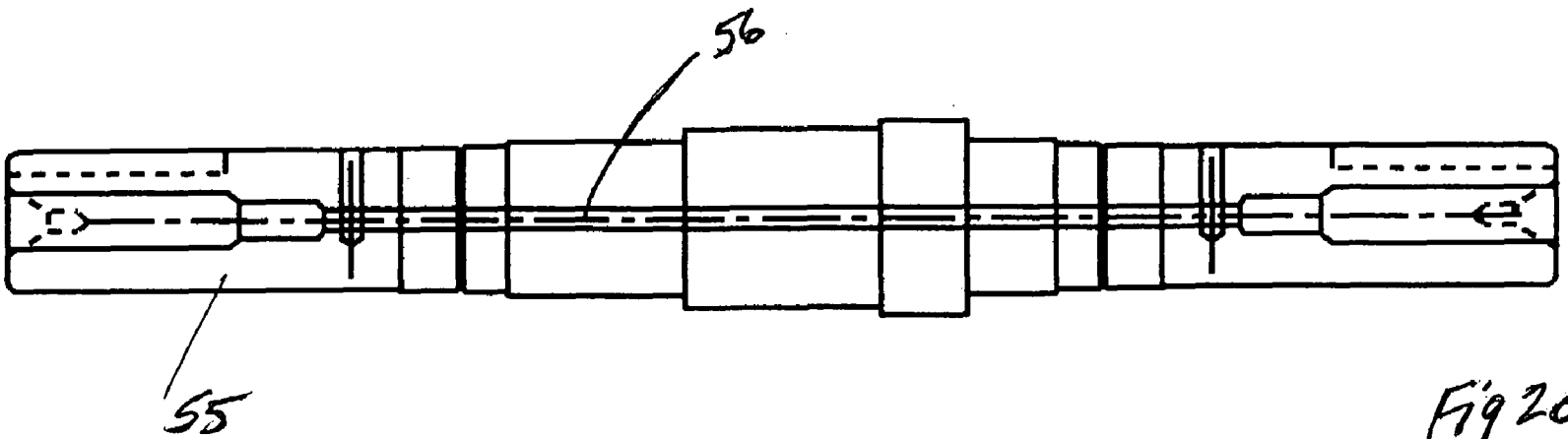
FIG. 20 shows a side view of one embodiment of the shaft.

FIG. 20 shows the shaft 55 having an oil passage 56 for allowing the flow of lubricating oil to the engine 32 components.

Figure 21:
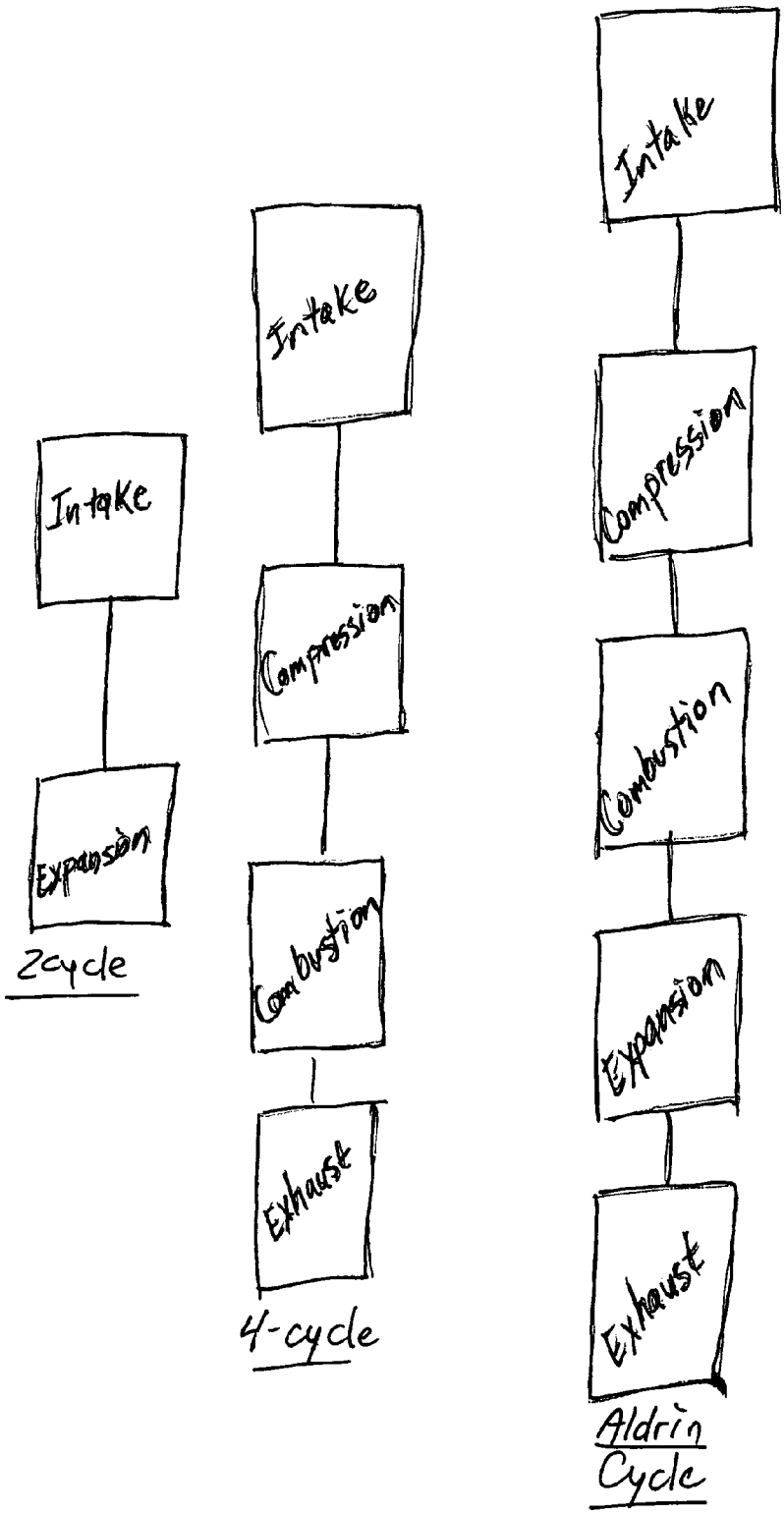
FIG. 21 shows a block diagram of the various cycles of the two cycle, four cycle engines and the embodiment disclosed.

FIG. 21 is a flow chart showing the cycles of a two cycle, four cycle and the modular engine disclosed herein which is referred to as the Aldrin cycle.

Figure 22:
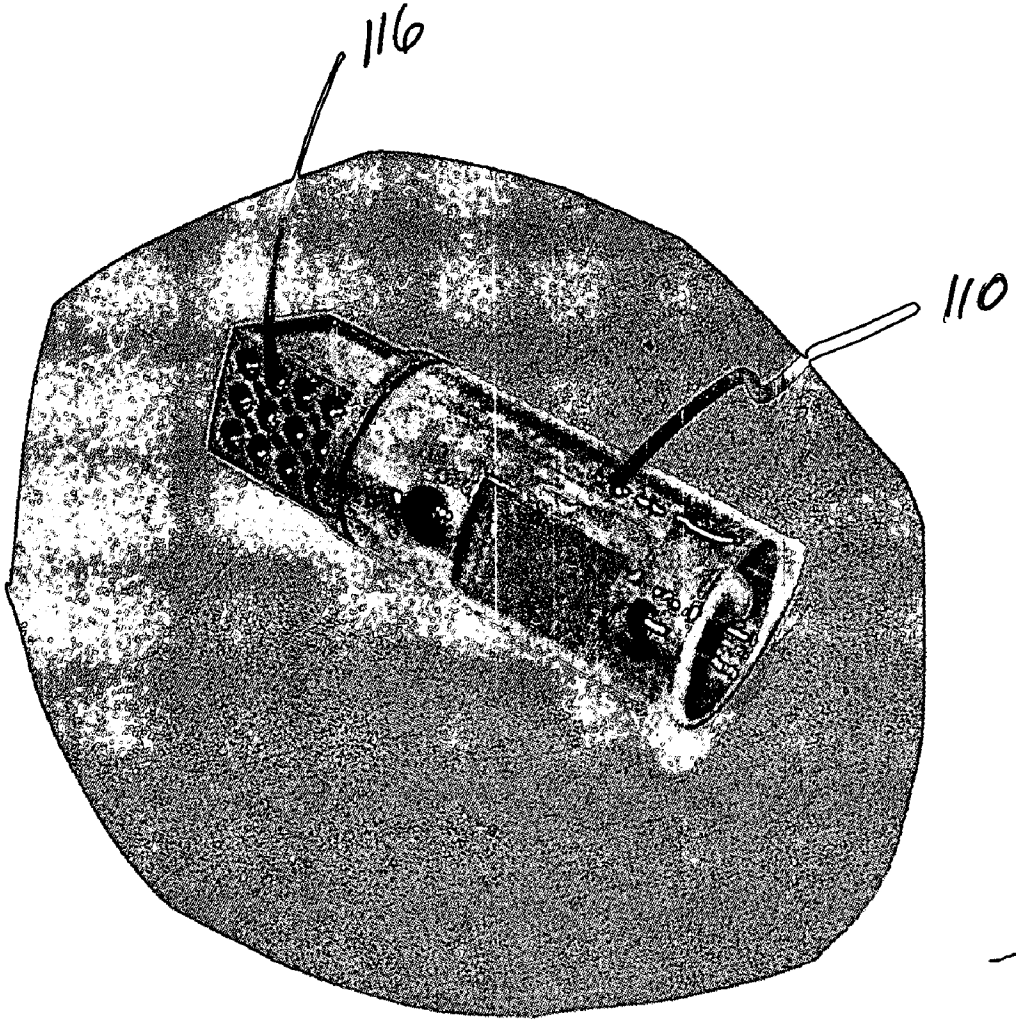
FIG. 22 is a perspective view of one embodiment of the vane.
Figure 23:
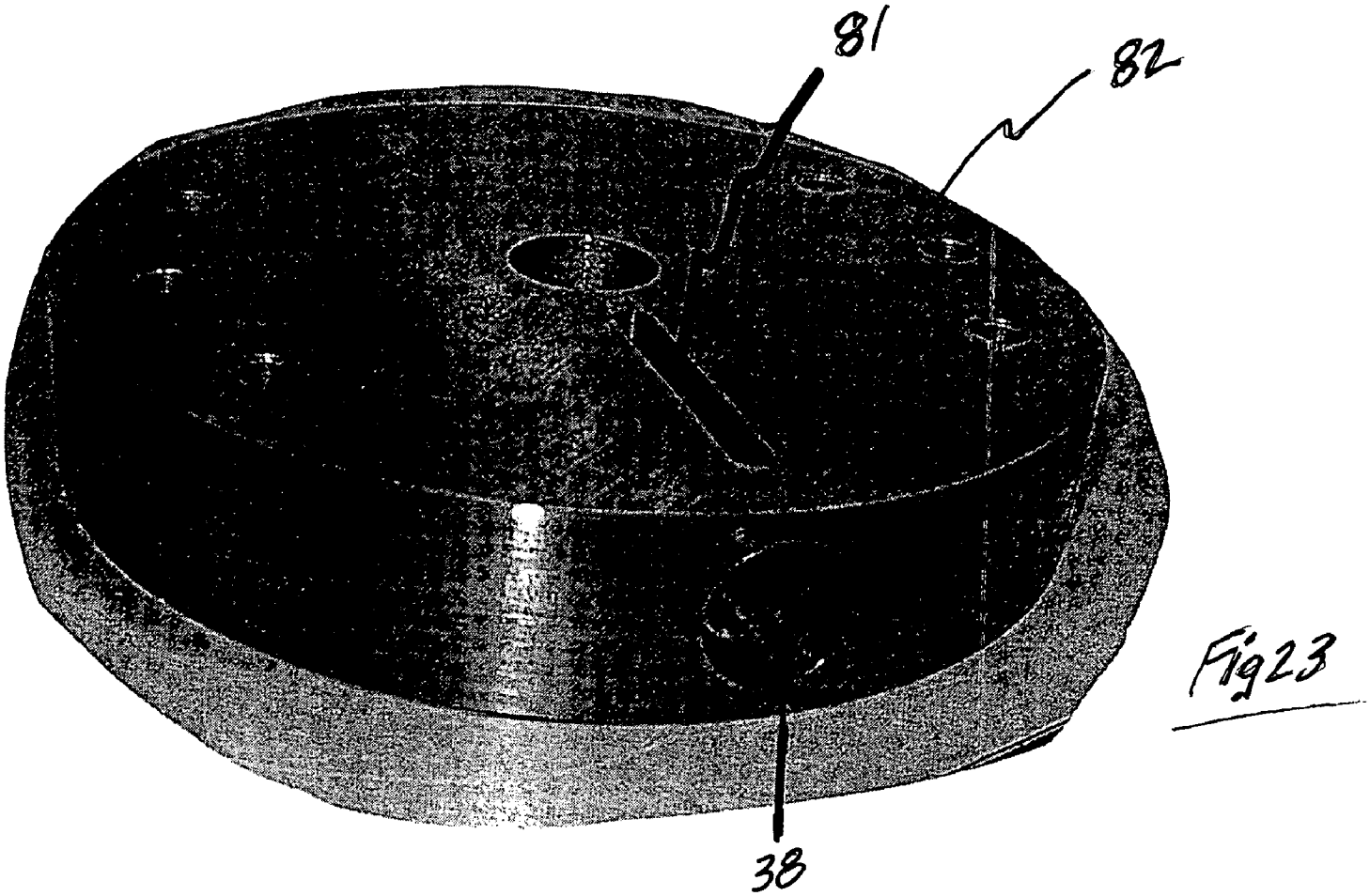
FIG. 23 is a perspective view of one embodiment of the rotor.

FIG. 22 is a perspective view of one embodiment of the vane 110. FIG. 23 is a perspective view of one embodiment of the rotor 82.

Figure 24:
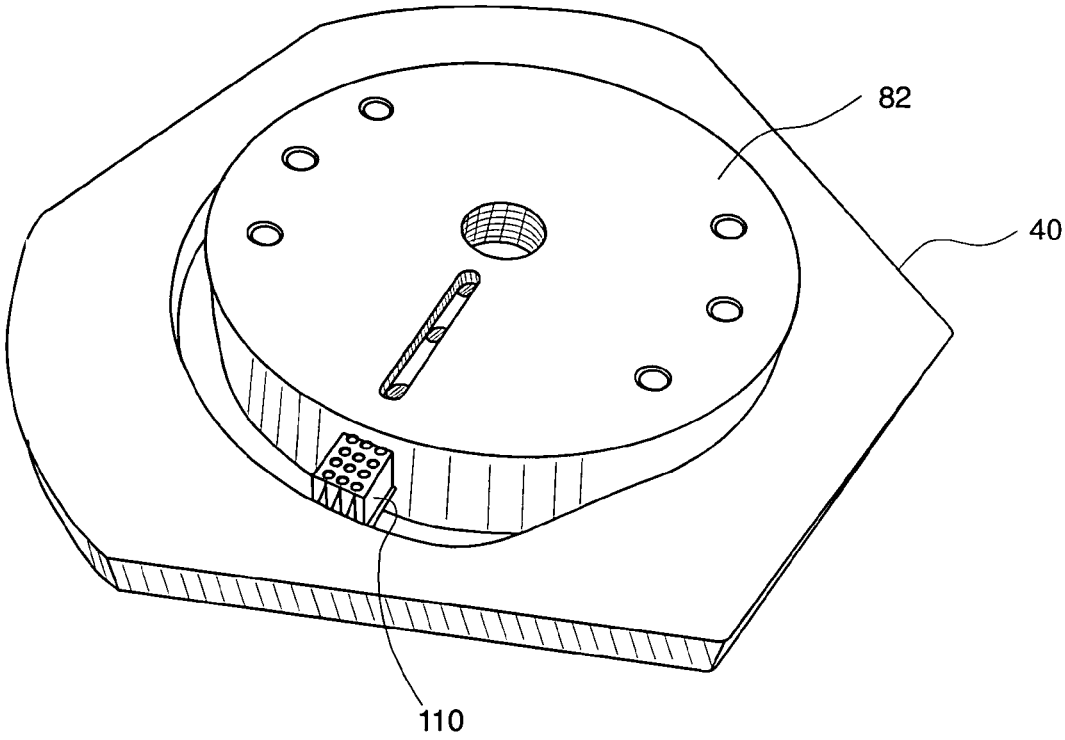
FIG. 24 is a perspective view of one embodiment of a center body, rotor and vane for illustrative purposes.

FIG. 24 is a perspective view of one embodiment of a center body 40, rotor 82 and vane 110 for illustrative purposes. In FIG. 24, the rotor 82 and vane 110 are shown off center of the center body 40. The engine 32 would have the rotor 82 and vane 110 centered between the edges of the center body 40.

Figure 25:
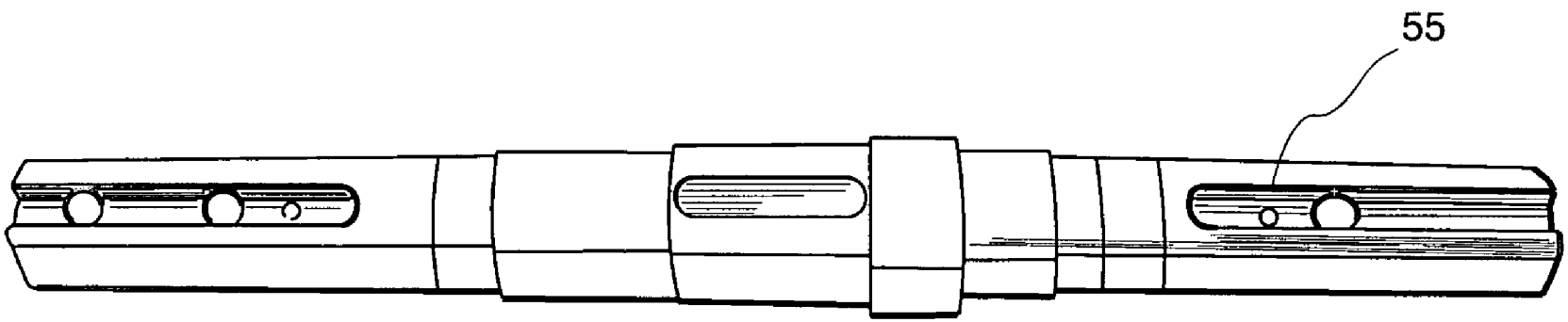
FIG. 25 is a side view of one embodiment of the shaft.
Figure 26:
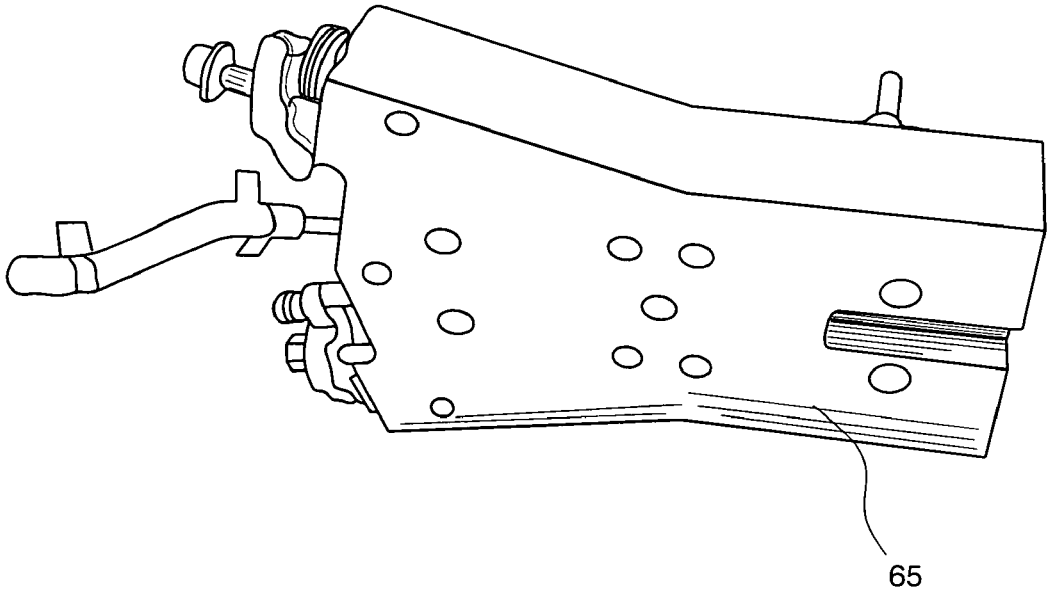
FIG. 26 is a side view of one embodiment of the combustion assembly.

FIG. 25 shows a side view of one embodiment of the shaft 55. FIG. 26 shows a side perspective view of one embodiment of the combustion assembly 65.

Figure 27:
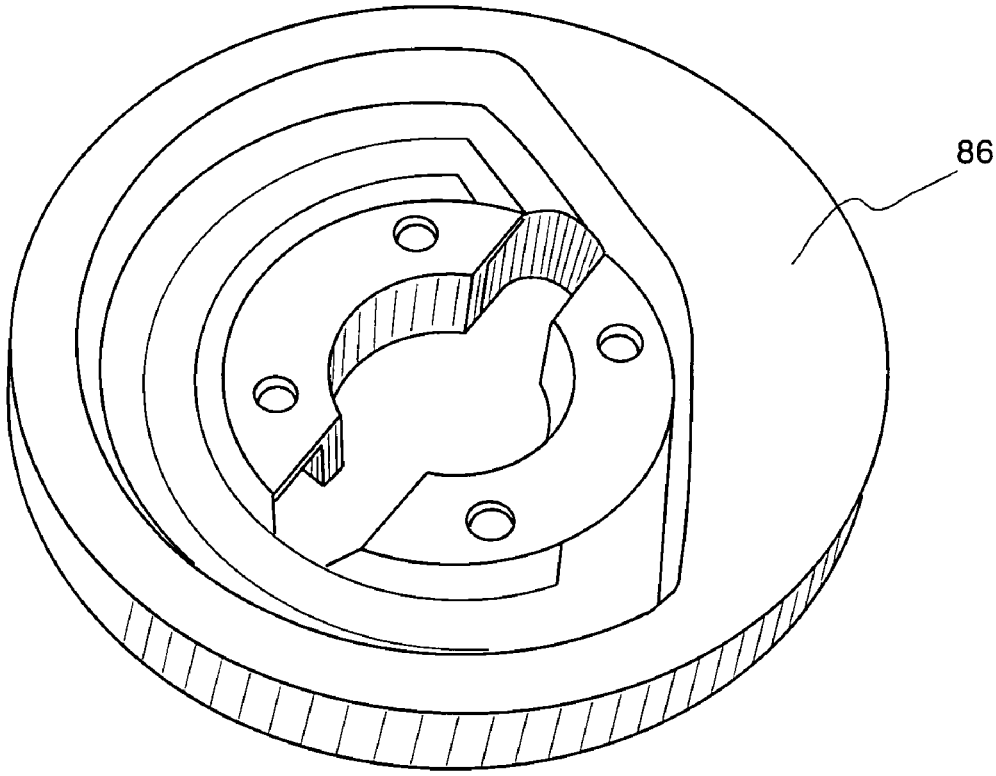
FIG. 27 is a perspective view of one embodiment of a balancer.

FIG. 27 shows one embodiment of a balancer 86. One or more balancers 86 may be needed depending upon the load and rpm of the engine 32 to minimize vibrations and aid performance.

FIG. 28 shows a side view of the engine 32. This embodiment of engine 32 comprises the compression source 62 interconnected by compression inlet 61 to the valve body 60 where the compressed air is combined with the fuel in the combustion assembly 65. From the combustion assembly 65 the burning expanding air fuel mixture is forced into the expansion chamber 35 through the expansion port 49 where the air fuel mixture continues to expand and creates power which is transmitted to the shaft 55 to do work. The spent air fuel mixture exits exhaust port 48. Some power can also be fed through a variable speed drive 170 to drive the compression source 62. FIG. 29 is similar to FIG. 28, but without the variable speed drive 170 and the shaft 55 directly drives the compression source 62. Though FIGS. 28 & 29 show shaft 55 connected between the expansion chamber 35 and compression source 62 it is anticipated that these elements may operate independently of one another.

Figure 30:
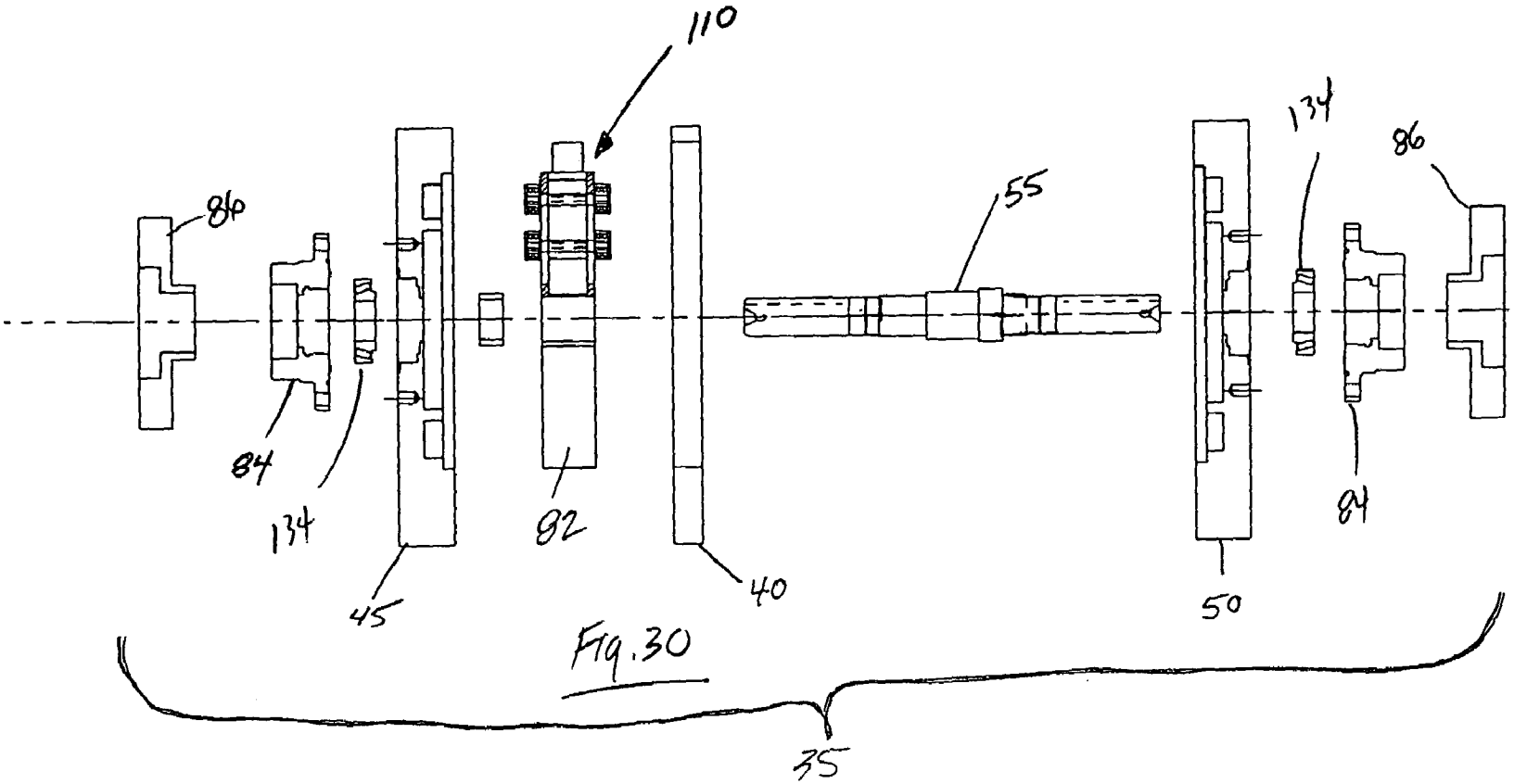
FIG. 30 shows one embodiment of an exploded view of the expansion chamber and related elements.
Figure 31:
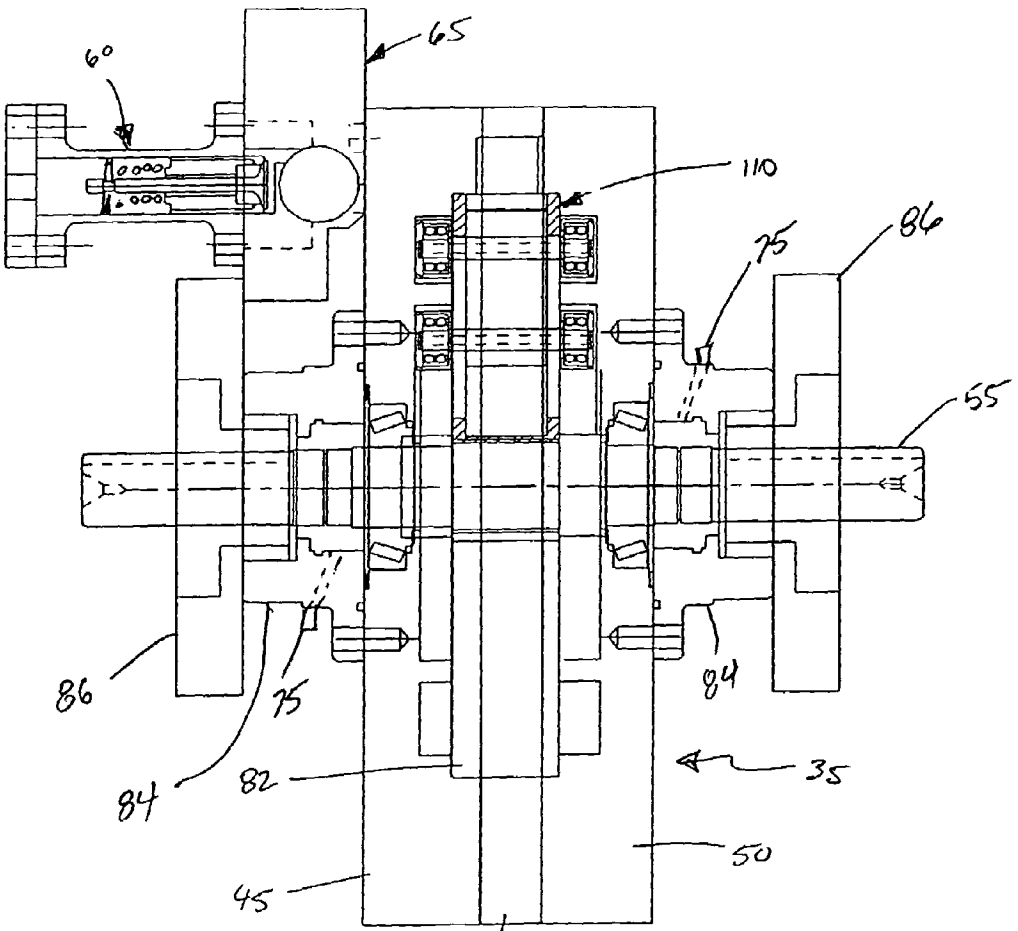
FIG. 31 shows a detailed assembly view of one embodiment of the intake assembly, combustion assembly and expansion chamber.

FIG. 30 is an exploded view of one embodiment of the expansion chamber 35 showing the assembly of the first cap 84 and balancer 86 attaching to the first plate 45. The first plate 45, center body 40 and second plate 50 house the rotor 82 which houses the vane 110. The rotor 82 is located between the first plate 45, center body 40 and second plate 50. The shaft 55 runs through the center of these elements and is fixed relative to the rotor 82 with a key or other conventional means for fixing against relative rotation (not shown). Likewise, second plate 50 is attached to center body 40 and first plate 45. Second plate 50 is attached to first cap 84 and balancer 86. Bearing 134 is also secured between first cap 84 and second plate 50, and first cap 84 and first plate 45.

Figure 32:
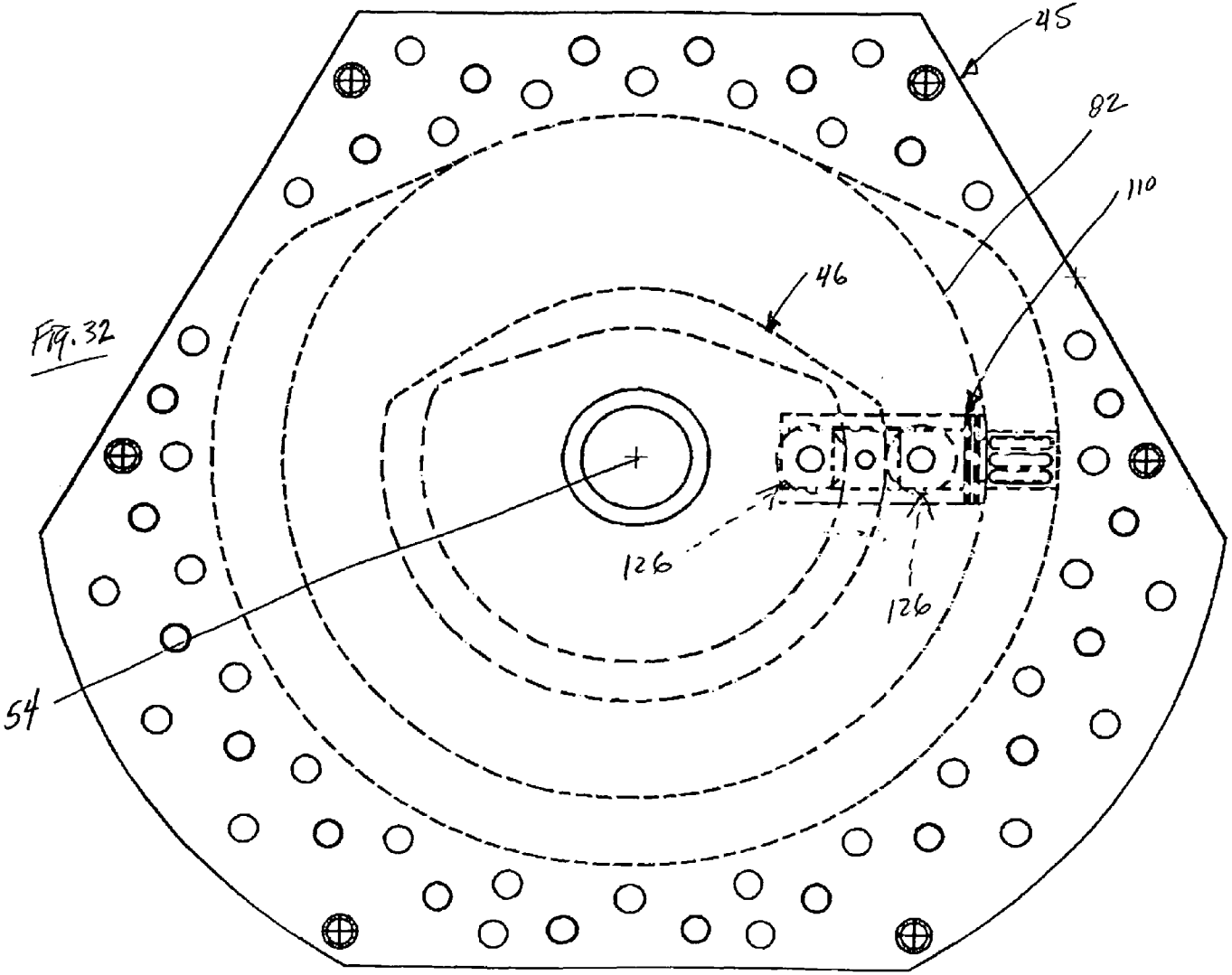
FIG. 32 shows a side view of one embodiment of the first plate with rotor and vane installed.

FIG. 32 shows another view of the first plate 45 and rotor 82 with vane 110 and the bearing assemblies 126 riding the cam 46.

Figure 34:
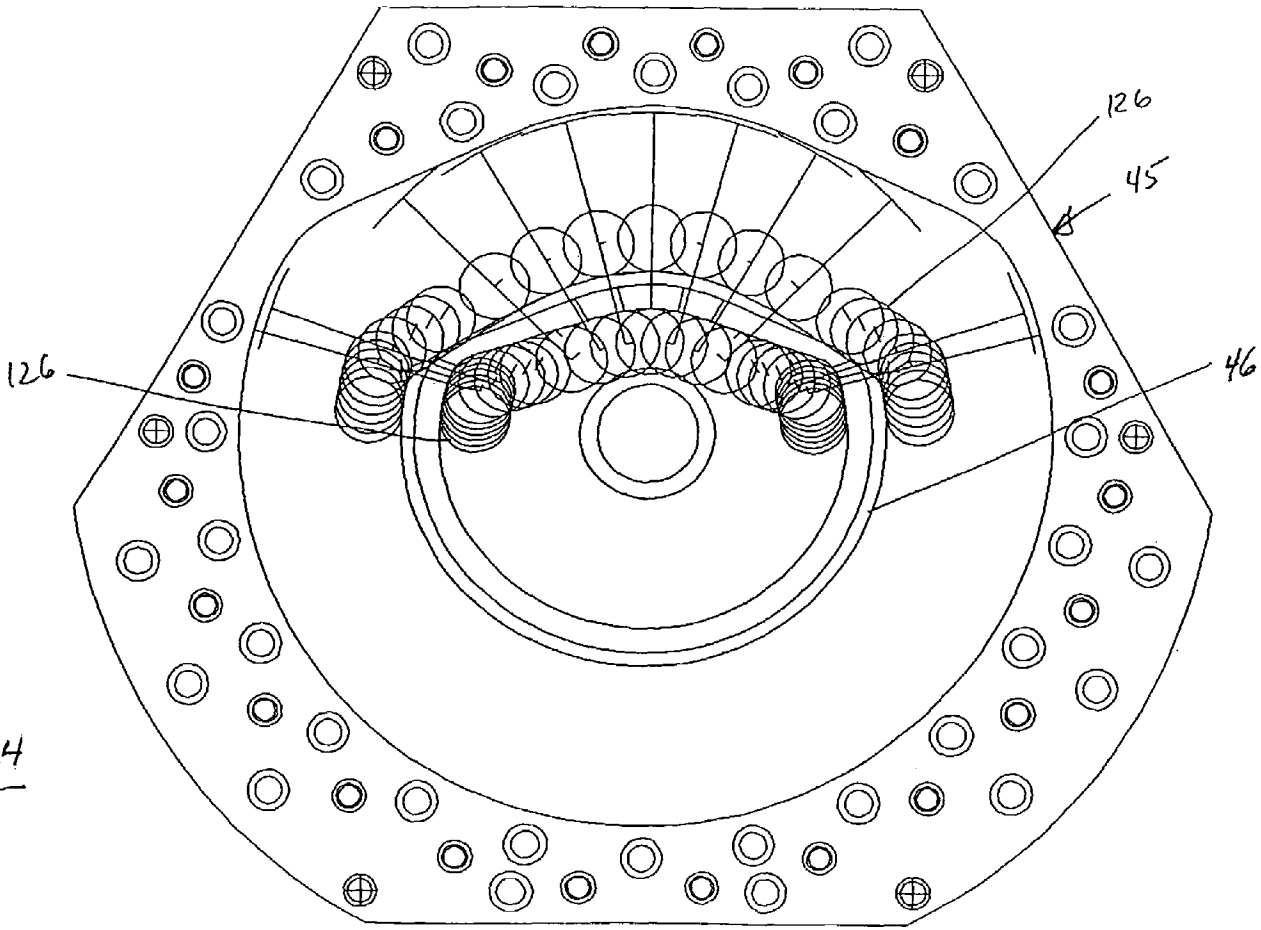
FIG. 34 shows a side view of one embodiment and graphic representation of the movement of the bearing assemblies.

FIG. 34 shows the first plate 45 with the paths of the bearing assemblies 126 around the cam 46.

Figure 33:
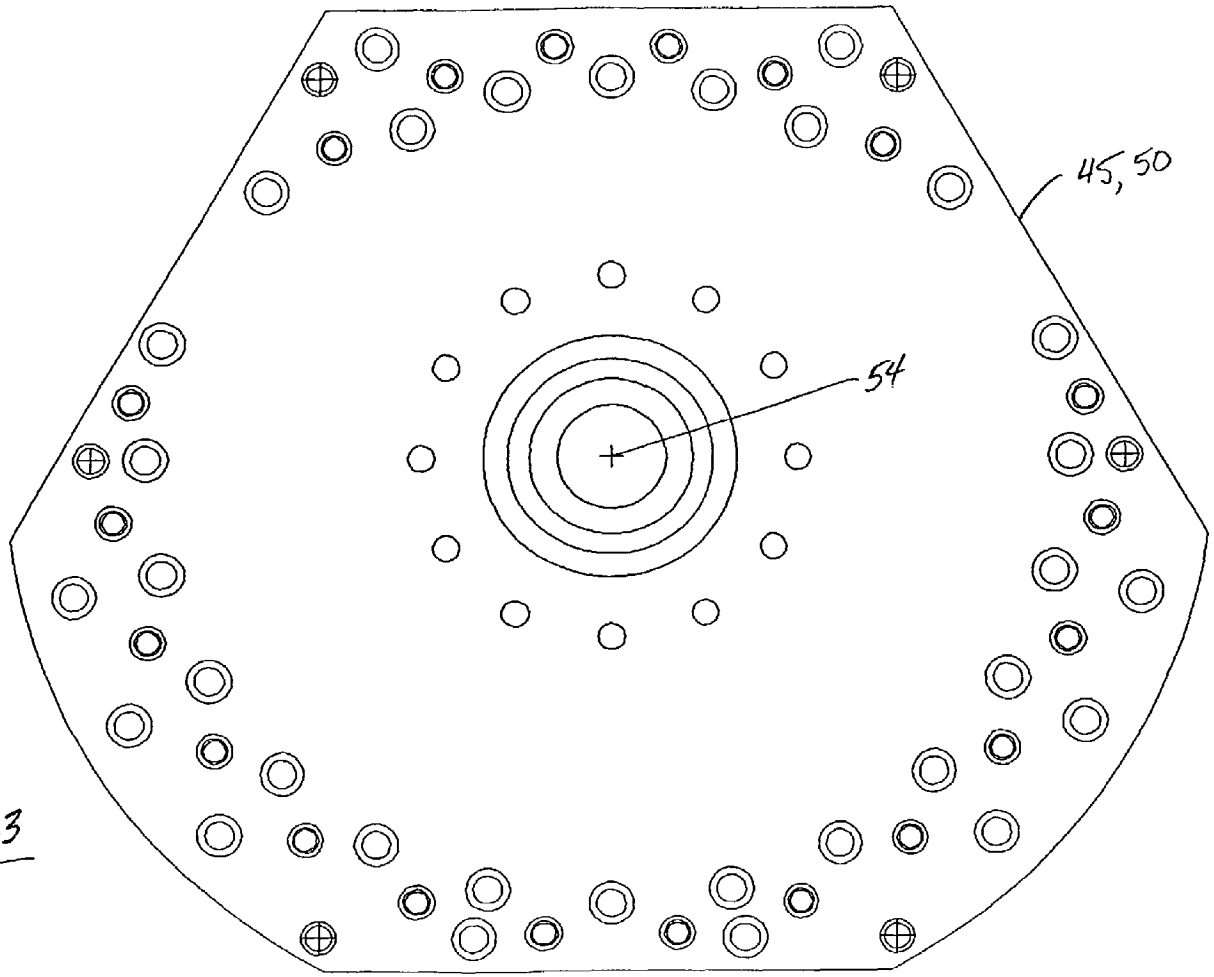
FIG. 33 shows one embodiment of the outer surface of one embodiment of the first and second plates.

FIG. 33 shows the outer surface of first plate 45 and second plate 50.

Figure 35:
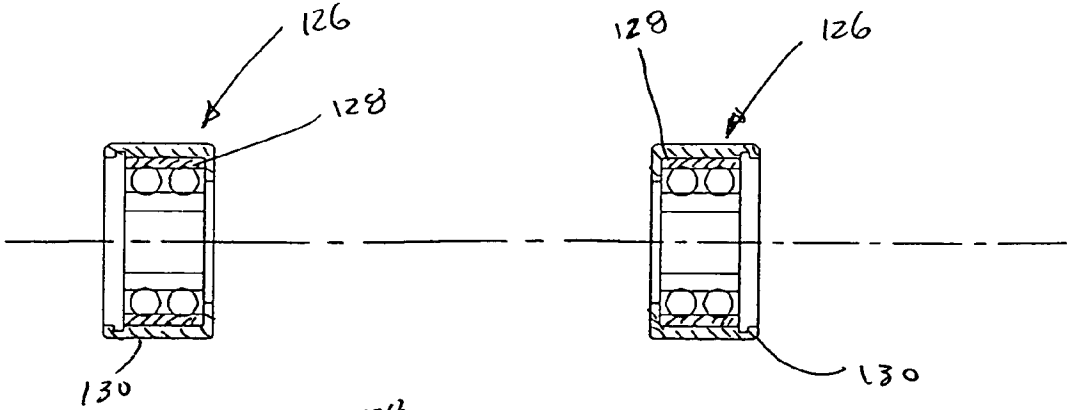
FIG. 35 shows one embodiment of a cutaway view of the bearing assembly.
Figure 36:
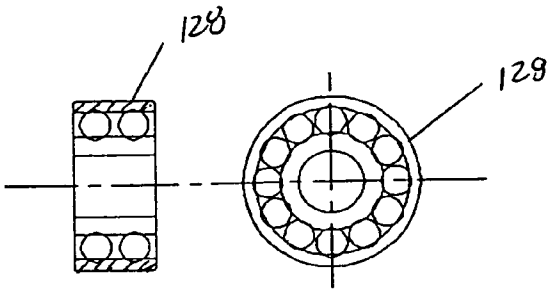
FIG. 36 shows two views of one embodiment of the bearings.
Figure 37:
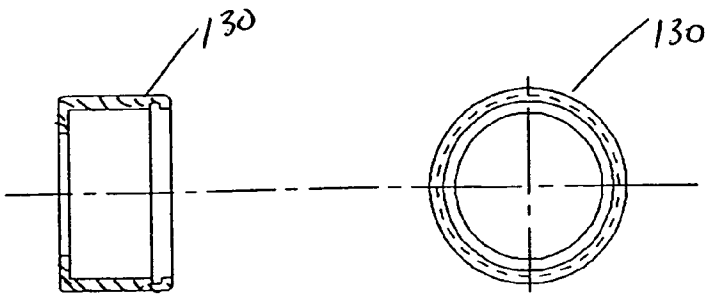
FIG. 37 shows two views of one embodiment of the cap.

FIGS. 35, 36, 37 show the bearing assemblies 126 comprised of bearings 128 and caps 130, where the bearings 128 are housed within the caps 130 and secured to shafts 132 best shown in FIG. 38.

FIGS. 38, 39, 40 show detailed views of one embodiment of the body 122 of the vane 110 with the guide shaft assembly 124 attached. The body 122 also has a top seal 112 and side seal 116 for discouraging the flow of expanding air fuel mixture around the body 122 of vane 110 as shown best in FIG. 12.

In these embodiments, the top seal 112 is a plurality of slots cut into the top of the vane 110. This top seal 112 works in conjunction with the seal 41 of the center body 40, FIG. 12.

The side seal 116 is a plurality of holes cut into both sides of the vane 110, FIG. 39. The side seals 116 work in conjunction with the plate seal 52 of the first and second plates 45, 50, FIG. 17.

While these embodiments show slots for the top seal 112, FIGS. 13 & 13A show a plurality of holes for the top seal 112.

Figures 41, 42, 43:
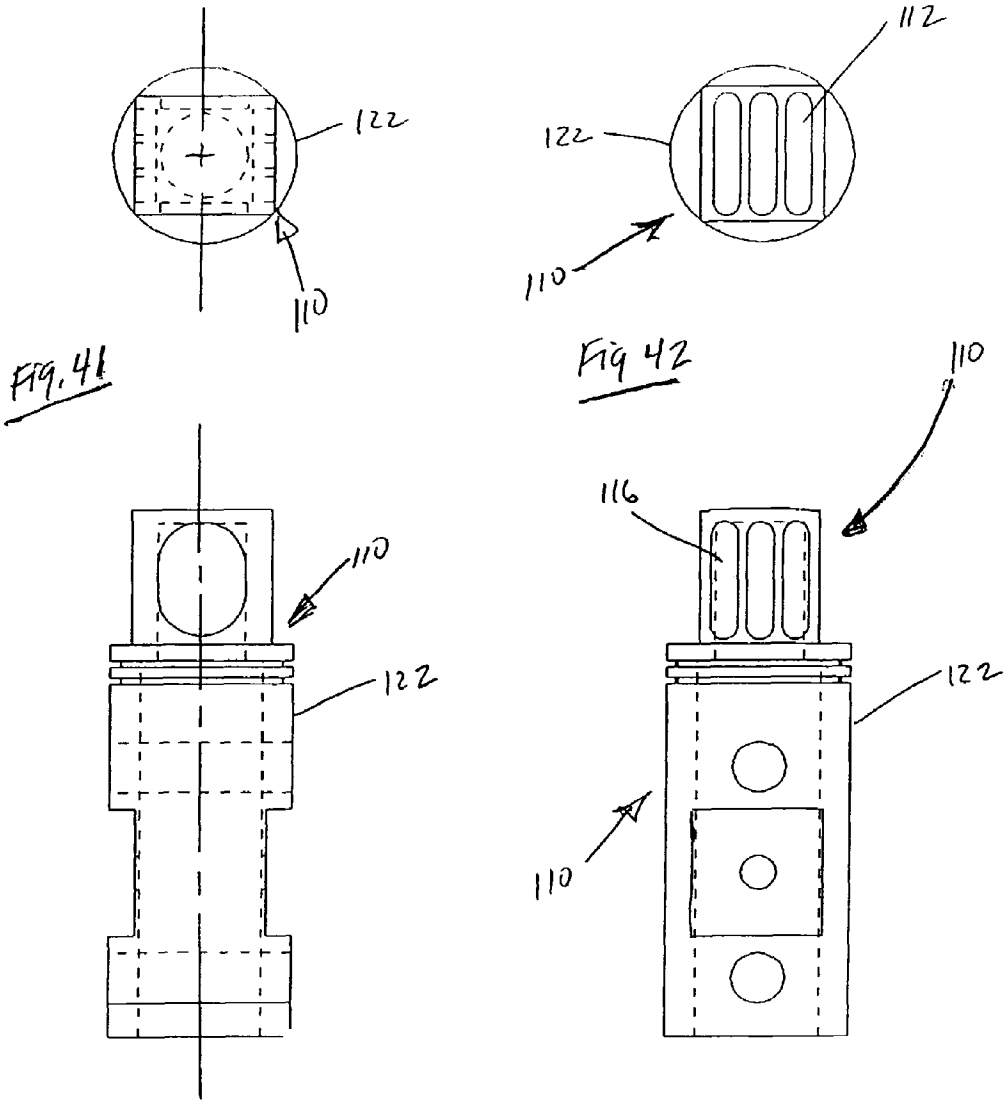
FIG. 41 shows a top and side view of another embodiment of the vane.
FIG. 42 shows a top and side view of another embodiment of the vane.
FIG. 43 shows a bottom view of one embodiment of the vane.

FIGS. 41, 42, 43 show an alternative embodiment of the vane 110 having a different type of side seal 116 than that of FIG. 39.

In these embodiments, FIG. 42 shows a plurality of slots for the top seal 112 and a plurality of slots for the side seal 116. The top seal 112 works in conjunction with the seal 41 of the center body 40. The side seals 116 work in conjunction with the plate seal 52 of the first and second plates 45, 50 as has been described prior.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

It must be further noted that a plurality of the following claims may express certain elements as means for performing a specific function, at times without the recital of structure or material. As the law demands, these claims shall be construed to cover not only the corresponding structure and material expressly described in this specification but also all equivalents thereof whether now known or hereafter developed or discovered.

What is claimed is:

1. A modular engine, the engine comprising:

a modular compression source connected to a compression inlet;

the compression inlet connected to a modular valve body, the modular valve body having a valve for metering the flow of air to a modular combustion assembly through a passage;

the modular combustion assembly having a fuel source, injector and a plug;

a valve assembly housed within the modular combustion assembly for mixing the air fuel mixture, the plug for igniting the air fuel mixture, the valve assembly for urging the ignited air fuel mixture through an expansion port;

the expansion port connected to a expansion chamber, the expansion chamber having an expansion port in a first plate, a second plate having an exhaust port, a center body housing a rotor and a vane, the center body affixed on one side to the first plate and on an opposite side to the second plate, a shaft engaging the first plate, center body, rotor and second plate, the side of the first plate adjacent to the center body having a cam, the side of the second plate adjacent the center body having a cam in correspondence to the cam on the first plate;

the vane having a pair of guide shaft assemblies extending through the vane and from the center body, the guide shaft assemblies having a shaft attached to a bearing assembly on each end of the shaft;

one bearing assembly in contact with the top of the cam in the first plate and an opposite bearing assembly in contact with the top of the cam in the second plate;

the other bearing assembly in contact with the bottom of the cam in the first plate and an opposite bearing assembly in contact with the bottom of the cam in the second plate;

rotation of the vane and contact of the bearing assemblies with the cams causing the vane to translate into and out of the center body;

the vane having a seal on a top surface, the vane having a seal and on the sides parallel to the first plate and second plate;

the first and second plates having a seal around the inner surface adjacent to the travel of the side vane seals; and the center body having a seal adjacent to the seal on top surface of the vane.

2. A modular engine, the engine comprising:

a modular valve body containing a valve and a compression inlet;

a modular compression source connected to the valve body by the compression inlet, the compression inlet providing compressed air from the compression source to the valve body;

the valve body connected to a combustion assembly, the valve body for metering and providing compressed air to the combustion assembly;

the modular combustion assembly connected to a fuel source and fuel injectors, the combustion assembly having a valve assembly for mixing the compressed air and fuel and igniting and metering the ignited mixture to an expansion chamber;

the expansion chamber having a first plate and second plate, the first plate and second plate sandwiching a center body, the first plate having a cam, the cam located on the inner surface, the second plate having a cam located on the inner surface and matching the cam in the first plate;

a rotor attached to a shaft, the rotor having a hole for receiving and housing a vane and a pair of corresponding slots, the rotor located between the first plate, second plate and concentric with the center body, the vane partially translatable into the rotor and out of the rotor to a position near the first plate, second plate and center body, the vane having a top seal discouraging the flow between the center body and the top seal, the vane having a side seal on each side for discouraging flow between the first plate and second plate and the side seals, a pair of guide shaft assemblies having a bearing and cap located on each end of a shaft, a first shaft extending from the center body on each side such that one end of the guide shaft assembly rides on the top of the cam in the first plate and the other end of the guide shaft assembly rides on the top of the cam in the second plate, a second shaft extending from the center body on each side such that one end of the guide shaft assembly rides on the bottom of the cam in the first plate and the other end of the guide shaft assembly rides on the bottom of the cam in the second plate;

the modular expansion chamber receiving the air fuel mixture, the air fuel mixture expanding and contacting the vane resulting in rotation of the vane, rotor and shaft;

the shaft located through the first plate, rotor, center body and second plate along a common axis where rotation of the shaft provides output power from the engine; and a control module for reading input parameters and calculating output parameters for optimizing and controlling the engine.

* * * * *